US009734772B2

(12) United States Patent
Mitsui et al.

(10) Patent No.: US 9,734,772 B2
(45) Date of Patent: Aug. 15, 2017

(54) DISPLAY DEVICE

(71) Applicant: Japan Display Inc., Tokyo (JP)

(72) Inventors: Masashi Mitsui, Tokyo (JP); Toshiyuki Nagatsuma, Tokyo (JP)

(73) Assignee: Japan Display Inc., Tokyo (JP)

( * ) Notice: Subject to any disclaimer, the term of this patent is extended or adjusted under 35 U.S.C. 154(b) by 119 days.

(21) Appl. No.: 14/695,072

(22) Filed: Apr. 24, 2015

(65) Prior Publication Data

US 2015/0332642 A1 Nov. 19, 2015

(30) Foreign Application Priority Data

May 15, 2014 (JP) ..... 2014-101755

(51) Int. Cl.

| | |
|---|---|
| ***G09G 3/36*** | (2006.01) |
| ***G09G 3/20*** | (2006.01) |
| ***G09G 5/24*** | (2006.01) |

(52) U.S. Cl.

CPC ..... *G09G 3/3607* (2013.01); *G09G 3/2066* (2013.01); *G09G 3/2081* (2013.01); *G09G 3/3648* (2013.01); *G09G 5/243* (2013.01); *G09G 2300/0452* (2013.01); *G09G 2320/04* (2013.01); *G09G 2320/0666* (2013.01); *G09G 2330/021* (2013.01); *G09G 2340/06* (2013.01); *G09G 2340/145* (2013.01)

(58) Field of Classification Search

CPC ..... G09G 2320/0666; G09G 2330/021; G09G 2340/06; G09G 2340/145; G09G 3/2066; G09G 3/2081; G09G 3/3607; G09G 3/3648; G09G 5/243

See application file for complete search history.

(56) References Cited

U.S. PATENT DOCUMENTS 7,542,601 B2 * 6/2009 Jin ..... H04N 9/68 348/703
8,194,094 B2 * 6/2012 Sakaigawa ..... G09G 3/2003 345/204

(Continued)

FOREIGN PATENT DOCUMENTS

JP 2012-22217 A 2/2012
JP 2012-053256 A 3/2012

(Continued)

*Primary Examiner* — Afroza Chowdhury
(74) *Attorney, Agent, or Firm* — Michael Best & Friedrich LLP

(57) ABSTRACT

A display device includes: a display unit including pixels arranged in a matrix therein, each of the pixels including a first sub-pixel that displays a first color component, a second sub-pixel that displays a second color component, a third sub-pixel that displays a third color component, and a fourth sub-pixel that displays a fourth color component; and a signal processing unit that receives input signals that are capable of being displayed with the first sub-pixel, the second sub-pixel, and the third sub-pixel, and calculates output signals to the first, second, third, and fourth sub-pixels. The signal processing unit generates converted input signals with changed saturation among the input signals. The signal processing unit calculates output signals to the first sub-pixel, the second sub-pixel, and the third sub-pixel based on the converted input signals and an amount of increase in brightness caused by the fourth sub-pixel.

4 Claims, 17 Drawing Sheets

(56) References Cited

U.S. PATENT DOCUMENTS

| | | | | |
|---|---|---|---|---|
| 9,324,283 | B2 * | 4/2016 | Kabe | G09G 3/3648 |
| 2007/0081177 | A1 * | 4/2007 | Um | H04N 1/6058 358/1.9 |
| 2009/0315921 | A1 | 12/2009 | Sakaigawa et al. | |
| 2012/0013649 | A1 | 1/2012 | Higashi et al. | |
| 2012/0050345 | A1 | 3/2012 | Higashi et al. | |
| 2014/0168284 | A1 | 6/2014 | Kabe et al. | |
| 2014/0285539 | A1 | 9/2014 | Kurokawa et al. | |
| 2014/0320534 | A1 * | 10/2014 | Kimura | G06T 11/60 345/634 |

FOREIGN PATENT DOCUMENTS

| | | | |
|---|---|---|---|
| JP | 5568074 | B2 | 6/2014 |
| JP | 2014-139647 | A | 7/2014 |
| JP | 2014-186245 | A | 10/2014 |

* cited by examiner

DISPLAY DEVICE

CROSS-REFERENCE TO RELATED APPLICATIONS

This application claims priority from Japanese Application No. 2014-101755, filed on May 15, 2014, the contents of which are incorporated by reference herein in its entirety.

BACKGROUND

1. Technical Field

The present invention relates to a display device.

2. Description of the Related Art

In recent years, demand has been increased for display devices for a mobile apparatus and the like such as a cellular telephone and electronic paper. In such display devices, one pixel includes a plurality of sub-pixels that output different colors. Such display devices allow one pixel to display various colors by switching ON/OFF the display of the sub-pixels. Display characteristics such as resolution and luminance have been improved year after year in such display devices. However, an aperture ratio is reduced as the resolution increases, so that luminance of a backlight needs to increase to achieve high luminance, which leads to increase in power consumption of the backlight. To solve this problem, techniques have been developed for adding a white pixel serving as a fourth sub-pixel to red, green, and blue sub-pixels known in the art (for example, refer to Japanese Patent Application Laid-open Publication No. 2012-108518). According to these techniques, the white pixel enhances the luminance to lower a current value of the backlight and reduce the power consumption.

In a case in which the current value of the backlight is not lowered, the luminance enhanced by the white pixel can be utilized to improve visibility under outdoor external light (for example, refer to Japanese Patent Application Laid-open Publication No. 2012-22217 (JP-A-2012-22217)). According to the technique of JP-A-2012-22217, an expansion coefficient for expanding an input signal is varied according to brightness of the input signal. Accordingly, the expansion coefficient increases as the brightness decreases, that is, as the gradation level decreases, and the expansion coefficient decreases as the brightness increases, that is, as the gradation level increases. As a result, the luminance on the low gradation side increases, and the visibility of the display device in the outdoors is improved.

The display device is desired to be lower in power consumption, or desired to be improved in visibility in the outdoors.

For the foregoing reasons, there is a need for a display device whose power consumption is suppressed or whose visibility in outdoors is improved.

SUMMARY

According to an aspect, a display device includes: a display unit including pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel. The signal processing unit generates converted input signals with changed saturation among the input signals. The signal processing unit calculates output signals to the first sub-pixel, the second sub-pixel, and the third sub-pixel based on the converted input signals and an amount of increase in brightness caused by the fourth sub-pixel.

DETAILED DESCRIPTION

Figure 1:
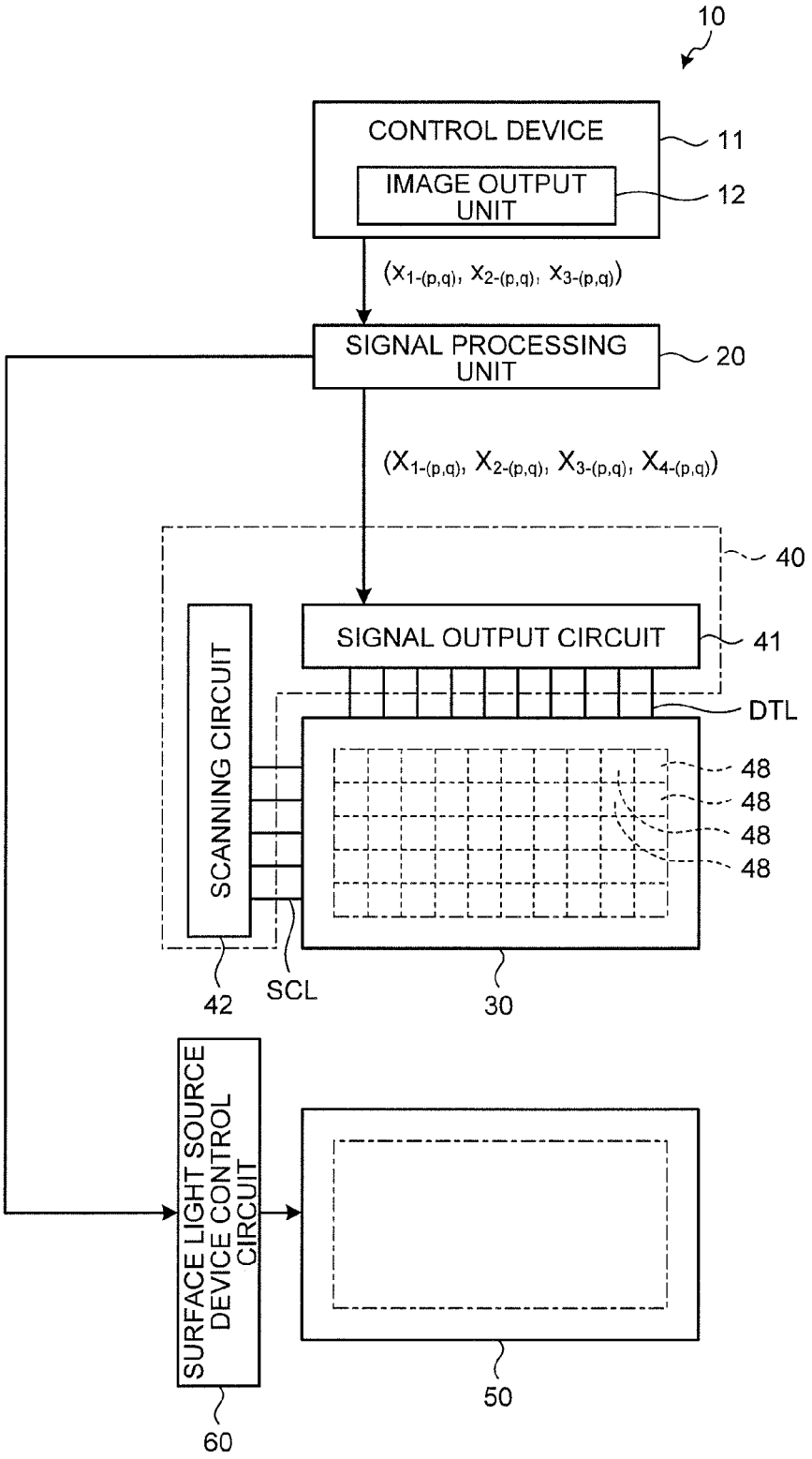
FIG. 1 is a block diagram illustrating an example of a configuration of a display device according to an embodiment.

The following describes a preferred embodiment in detail with reference to the drawings. The present invention is not limited to the embodiment described below. Components described below include a component that is easily conceivable by those skilled in the art and substantially the same component. The components described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Figure 2:
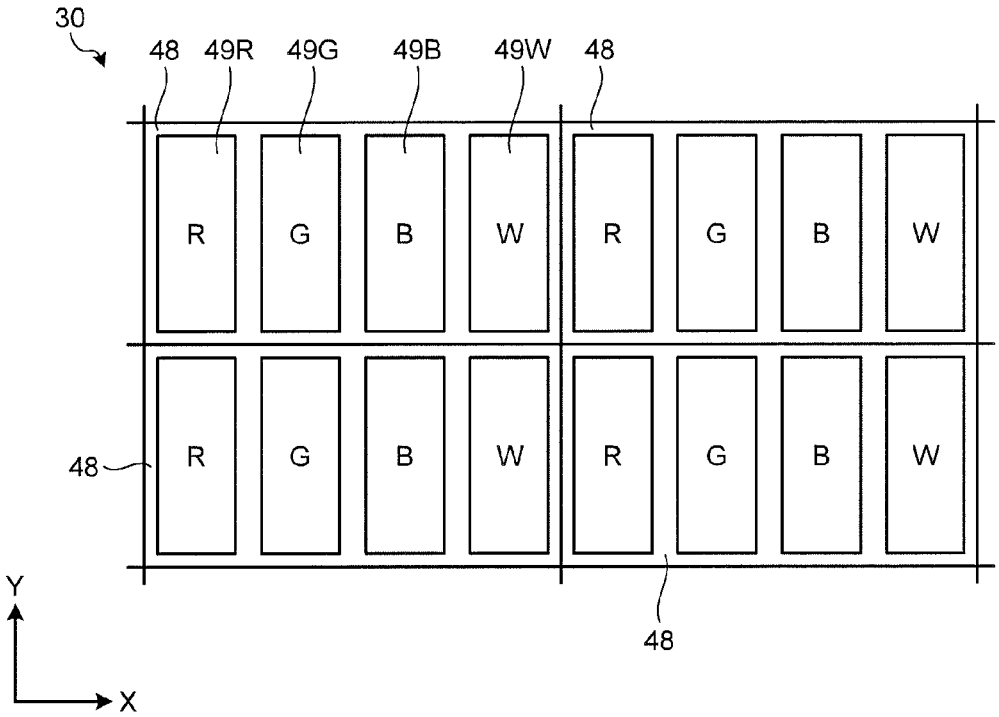
FIG. 2 is a diagram illustrating a pixel array of an image display panel according to the embodiment.
Figure 3:
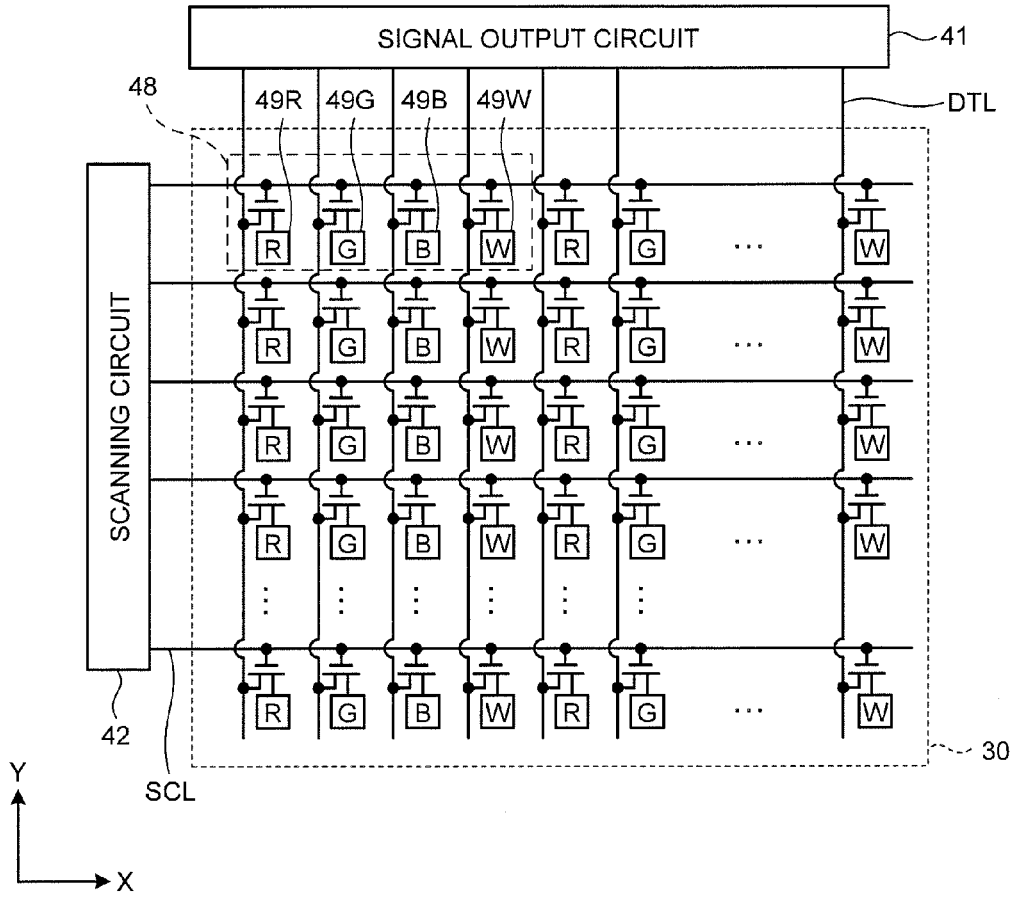
FIG. 3 is a conceptual diagram of the image display panel and an image display panel drive circuit of the display device according to the embodiment.
Figure 4:
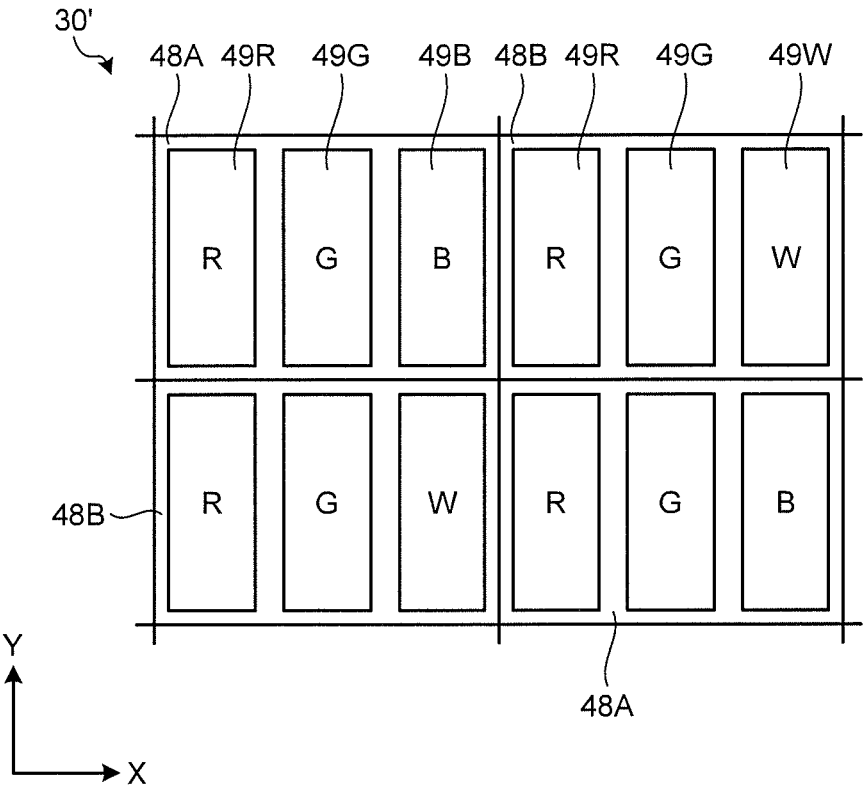
FIG. 4 is a diagram illustrating another example of the pixel array of the image display panel according to the embodiment.

FIG. 1 is a block diagram illustrating an example of a configuration of a display device according to an embodiment. FIG. 2 is a diagram illustrating a pixel array of an image display panel according to the embodiment. FIG. 3 is a conceptual diagram of the image display panel and an image display panel drive circuit of the display device according to the embodiment. FIG. 4 is a diagram illustrating another example of the pixel array of the image display panel according to the embodiment.

As illustrated in FIG. 1, a display device 10 includes a signal processing unit 20 that receives an input signal (RGB data) from an image output unit 12 of a control device 11 and executes predetermined data conversion processing on the signal to be output, an image display panel 30 that displays an image based on an output signal output from the signal processing unit 20, an image display panel drive circuit 40 that controls driving of the image display panel 30 (display unit), a surface light source device 50 that illuminates the image display panel 30 from its back surface, and a surface light source device control circuit 60 that controls driving of the surface light source device 50. The display device 10 has the same configuration as that of an image display device assembly disclosed in JP-A-2011-154323, and various modifications described in JP-A-2011-154323 can be applied thereto.

The signal processing unit 20 is a calculation processing unit that controls operations of the image display panel 30 and the surface light source device 50. The signal processing unit 20 is coupled to the image display panel drive circuit 40 for driving the image display panel 30, and the surface light source device control circuit 60 for driving the surface light source device 50. The signal processing unit 20 processes the input signal input from the outside to generate the output signal and a surface light source device control signal. That is, the signal processing unit 20 converts an input value (input signal) of an input signal in an input HSV color space into an extended value (output signal) in an extended HSV color space extended with a first color, a second color, a third color, and a fourth color components to be generated, and outputs the generated output signal to the image display panel 30. The signal processing unit 20 then outputs the generated output signal to the image display panel drive circuit 40 and outputs the generated surface light source device control signal to the surface light source device control circuit 60.

As illustrated in FIGS. 2 and 3, the pixels 48 are arranged in a two-dimensional matrix of $P_0 \times Q_0$ ($P_0$ in a row direction, and $Q_0$ in a column direction) in the image display panel 30. FIGS. 2 and 3 illustrate an example in which the pixels 48 are arranged in a matrix on an XY two-dimensional coordinate system. In this example, the row direction is the X-direction and the column direction is the Y-direction.

Each of the pixels 48 includes a first sub-pixel 49R, a second sub-pixel 49G, a third sub-pixel 49B, and a fourth sub-pixel 49W. The first sub-pixel 49R displays a first color component (for example, red as a first primary color). The second sub-pixel 49G displays a second color component (for example, green as a second primary color). The third sub-pixel 49B displays a third color component (for example, blue as a third primary color). The fourth sub-pixel 49W displays a fourth color component (for example, white). In the following description, the first sub-pixel 49R, the second sub-pixel 49G, the third sub-pixel 49B, and the fourth sub-pixel 49W may be collectively referred to as a sub-pixel 49 when they are not required to be distinguished from each other. The image output unit 12 described above outputs RGB data that can be displayed with the first color component, the second color component, and the third color component in the pixel 48 as the input signal to the signal processing unit 20.

More specifically, the display device 10 is a transmissive color liquid crystal display device. The image display panel 30 is a color liquid crystal display panel in which a first color filter that allows the first primary color to pass through is arranged between the first sub-pixel 49R and an image observer, a second color filter that allows the second primary color to pass through is arranged between the second sub-pixel 49G and the image observer, and a third color filter that allows the third primary color to pass through is arranged between the third sub-pixel 49B and the image observer. In the image display panel 30, there is no color filter between the fourth sub-pixel 49W and the image observer. A transparent resin layer may be provided for the fourth sub-pixel 49W instead of the color filter. In this way, by arranging the transparent resin layer, the image display panel 30 can suppress occurrence of a large level difference in the fourth sub-pixel 49W, otherwise the large level difference occurs because of arranging no color filter for the fourth sub-pixel 49W. While the embodiment has been described with the example in which the fourth sub-pixel displays white, the embodiment is not limited to this example. Another color such as yellow may be displayed instead of white. To display, for example, yellow with the fourth sub-pixel, a color filter transmitting yellow may be arranged.

In the example illustrated in FIG. 2, the first sub-pixel 49R, the second sub-pixel 49G, the third sub-pixel 49B, and the fourth sub-pixel 49W are arranged similarly to a stripe array in the image display panel 30. A structure and an arrangement of the sub-pixels 49R, 49G, 49B, and 49W included in one pixel 48 are not specifically limited. For example, the first sub-pixel 49R, the second sub-pixel 49G, the third sub-pixel 49B, and the fourth sub-pixel 49W may be arranged similarly to a diagonal array (mosaic array) in the image display panel 30. The arrangement may be similar to a delta array (triangle array) or a rectangle array, for example. As in an image display panel 30' illustrated in FIG. 4, a pixel 48A including the first sub-pixel 49R, the second sub-pixel 49G, and the third sub-pixel 49B and a pixel 48B including the first sub-pixel 49R, the second sub-pixel 49G, and the fourth sub-pixel 49W are alternately arranged in the row direction and the column direction.

Generally, the arrangement similar to the stripe array is preferable for displaying data or character strings on a personal computer and the like. In contrast, the arrangement similar to the mosaic array is preferable for displaying a natural image on a video camera recorder, a digital still camera, or the like.

The image display panel drive circuit 40 includes a signal output circuit 41 and a scanning circuit 42. In the image display panel drive circuit 40, the signal output circuit 41 holds video signals to be sequentially output to the image display panel 30. The signal output circuit 41 is electrically coupled to the image display panel 30 via wiring DTL. In the image display panel drive circuit 40, the scanning circuit 42 controls ON/OFF of a switching element (for example, a thin film transistor (TFT)) for controlling an operation of the sub-pixel (light transmittance) in the image display panel 30. The scanning circuit 42 is electrically coupled to the image display panel 30 via wiring SCL.

The surface light source device 50 is arranged on a back surface of the image display panel 30, and illuminates the image display panel 30 by irradiating the image display panel 30 with light. The surface light source device 50 irradiates the entire surface of the image display panel 30 with light to illuminate the image display panel 30. The surface light source device control circuit 60 controls irradiation light quantity and the like of the light output from the surface light source device 50. Specifically, the surface light source device control circuit 60 adjusts a value or a duty ratio of a voltage to be supplied to the surface light source device 50 based on the surface light source device control signal output from the signal processing unit 20 to control the light quantity (light intensity) of the light with which the image display panel 30 is irradiated. The following describes a processing operation executed by the display device 10, more specifically, the signal processing unit 20.

Figure 5:
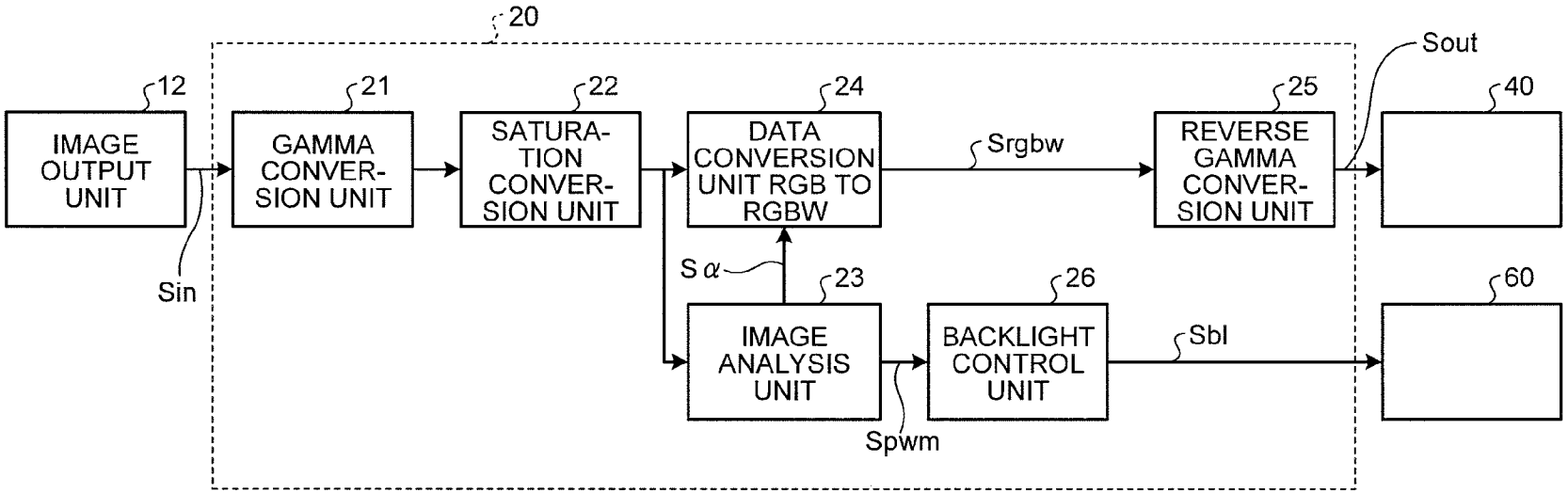
FIG. 5 is a block diagram for explaining a signal processing unit of the display device according to the embodiment.
Figure 6:
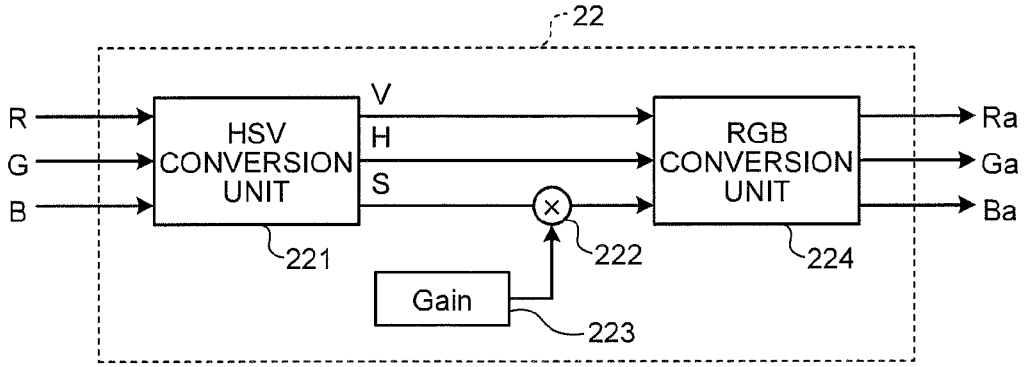
FIG. 6 is a block diagram for explaining a saturation conversion unit illustrated in FIG. 5.

FIG. 5 is a block diagram for explaining the signal processing unit of the display device according to the embodiment. FIG. 6 is a block diagram for explaining a saturation conversion unit illustrated in FIG. 5. The signal processing unit 20 includes a gamma conversion unit 21 that receives input signals Sin (RGB data) from the image output unit 12, a saturation conversion unit 22, an image analysis unit 23, a data conversion unit 24, a reverse gamma conversion unit 25, and a backlight control unit 26. The gamma conversion unit 21 applies gamma conversion to the input signals Sin (RGB data). As will be described later, the saturation conversion unit 22 converts the input signals Sin into HSV data, performs saturation conversion by multiplying saturation by a certain gain, and converts the results into RGB data. The image analysis unit 23 calculates control information Sα on an expansion coefficient α (to be described later) based on input values from the saturation conversion unit 22 and also calculates a surface light source device control signal Spwm based on the expansion coefficient α. The backlight control unit 26 controls the surface light source device control circuit 60 with a control signal Sbl based on the surface light source device control signal Spwm.

The data conversion unit 24 determines output intermediate signals Srgbw of the sub-pixels 49 in all the pixels 48 based on the input values from the saturation conversion unit 22 and the information Sα on the expansion coefficient α, and outputs the output intermediate signals Srgbw. The reverse gamma conversion unit 25 supplies output signals Sout that have been subjected to reverse gamma conversion based on the output intermediate signals Srgbw to the image display panel drive circuit 40.

Figure 7:
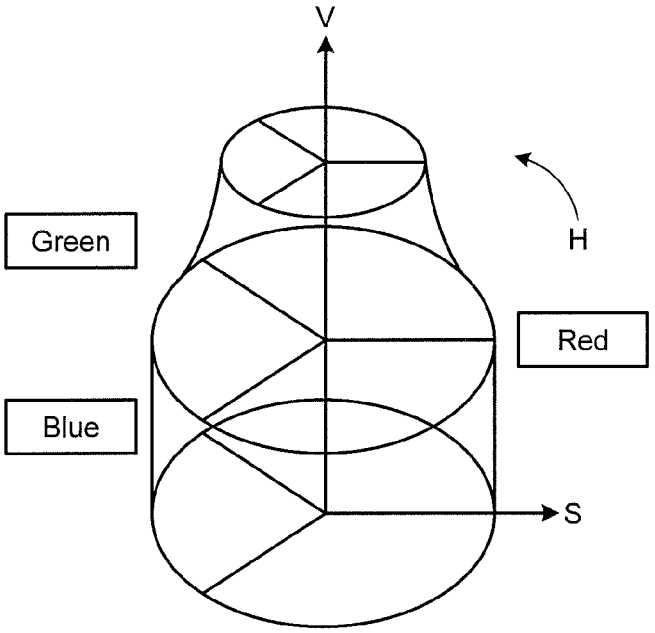
FIG. 7 is a conceptual diagram of an extended HSV color space that can be extended by the display device according to the embodiment.
Figure 8:
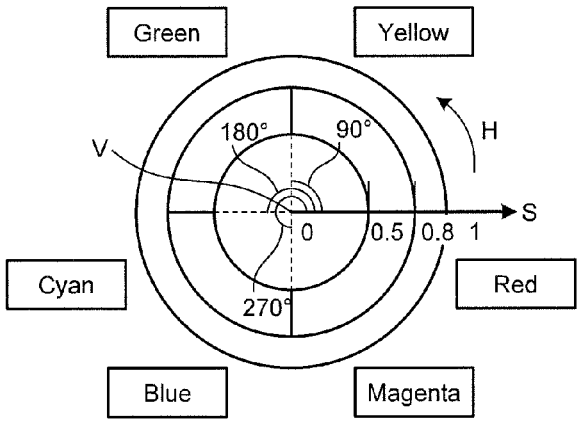
FIG. 8 is a conceptual diagram illustrating a relation between a hue and saturation in the extended HSV color space.

FIG. 7 is a conceptual diagram of an extended HSV color space that can be extended by the display device according to the embodiment. FIG. 8 is a conceptual diagram illustrating a relation between a hue and saturation in the extended HSV color space. The signal processing unit 20 receives an input signal that is information of an image to be displayed input from the outside. The input signal includes the information of the image (color) to be displayed at its position for each pixel 48 as the input signal. Specifically, in the image display panel 30 in which $P_0 \times Q_0$ pixels 48 are arranged in a matrix, with respect to the (p, q)-th pixel 48 (where $1 \leq p \leq P_0$, $1 \leq q \leq Q_0$), the signal processing unit 20 receives a signal including an input signal of the first sub-pixel 49R the signal value of which is $x_{1-(p,\ q)}$, an input signal of the second sub-pixel 49G the signal value of which is $x_{2-(p,\ q)}$, and an input signal of the third sub-pixel 49B the signal value of which is $x_{3-(p,\ q)}$ (refer to FIG. 1).

The saturation conversion unit 22 includes an HSV conversion unit 221, a saturation conversion processing unit 222, a saturation conversion setting unit 223, and an RGB conversion unit 224. In FIG. 6, the HSV conversion unit 221 of the saturation conversion unit 22 receives an input signal R of the first sub-pixel 49R the signal value of which is $x_{1-(p,\ q)}$, an input signal G of the second sub-pixel 49G the signal value of which is $x_{2-(p,\ q)}$, and an input signal B of the third sub-pixel 49B the signal value of which is $x_{3-(p,\ q)}$. The HSV conversion unit 221 calculates saturation S and brightness V(S) as follows: S=(Max−Min)/Max, and V(S)=Max. The saturation S can take a value of 0 to 1, and the brightness V(S) can take a value of 0 to $(2^n-1)$, where n is a number of display gradation bits. Max is the maximum value of the input signal values of the three sub-pixels, that is, the input signal value R of the first sub-pixel, the input signal value G of the second sub-pixel, and the input signal value B of the third sub-pixel, the input signal values being supplied to each of the pixels. Min is the minimum value of the input signal values of the three sub-pixels, that is, the input signal value R of the first sub-pixel, the input signal value G of the second sub-pixel, and the input signal value B of the third sub-pixel, the input signal values being supplied to each of the pixels. The HSV conversion unit 221 calculates a hue H as 60×(G−R)/(Max−Min)+60 if the minimum value of the input signal values of the three sub-pixels is B. The HSV conversion unit 221 calculates the hue H as 60×(B−G)/(Max−Min)+180 if the minimum value of the input signal values of the three sub-pixels is R. The HSV conversion unit 221 calculates the hue H as 60×(R−B)/(Max−Min)+300 if the minimum value of the input signal values of the three sub-pixels is G.

The saturation conversion processing unit 222 multiplies a gain value Sgain by the saturation S based on a set value set by the saturation conversion setting unit 223. The RGB conversion unit 224 converts the hue H, the brightness V(S), and the saturation S that has been processed by the saturation conversion processing unit 222 into a converted input signal Ra of the first sub-pixel 49R the signal value of which is $x_{1-(p,\ q)}$, a converted input signal Ga of the second sub-pixel 49G the signal value of which is $x_{2-(p,\ q)}$, and a converted input signal Ba of the third sub-pixel 49B the signal value of which is $x_{3-(p,\ q)}$.

The data conversion unit 24 of the signal processing unit 20 processes the input signals thereto, that is, the converted input signal Ra of the first sub-pixel 49R the signal value of which is $x_{1-(p,\ q)}$, the converted input signal Ga of the second sub-pixel 49G the signal value of which is $x_{2-(p,\ q)}$, and the converted input signal Ba of the third sub-pixel 49B the signal value of which is $x_{3-(p,\ q)}$. The data conversion unit 24 performs the processing to generate an output signal of the first sub-pixel for determining display gradation of the first sub-pixel 49R (signal value $X_{1-(p,\ q)}$), an output signal of the second sub-pixel for determining the display gradation of the second sub-pixel 49G (signal value $X_{2-(p,\ q)}$), an output signal of the third sub-pixel for determining the display gradation of the third sub-pixel 49B (signal value $X_{3-(p,\ q)}$), and an output signal of the fourth sub-pixel for determining the display gradation of the fourth sub-pixel 49W (signal value $X_{4-(p,\ q)}$). The data conversion unit 24 outputs the generated output signals of the first to fourth sub-pixels to the image display panel drive circuit 40.

In the display device 10, the pixel 48 includes the fourth sub-pixel 49W for outputting the fourth color component (for example, white) to widen a dynamic range of the brightness in the HSV color space (extended HSV color space) as illustrated in FIG. 7. That is, as illustrated in FIG. 7, a substantially trapezoidal three-dimensional shape, in which the maximum value of the brightness V is reduced as the saturation S increases, is placed on a cylindrical HSV color space that can be displayed by the first sub-pixel 49R, the second sub-pixel 49G, and the third sub-pixel 49B.

The signal processing unit 20 stores the maximum value Vmax(S) of the brightness using the saturation S as a variable in the HSV color space expanded by adding the fourth color component (for example, white). That is, the signal processing unit 20 stores the maximum value Vmax (S) of the brightness for respective coordinates (value) of the saturation S and the hue H regarding the three-dimensional shape of the HSV color space illustrated in FIG. 7. The input signals include the input signals of the first sub-pixel 49R, the second sub-pixel 49G, and the third sub-pixel 49B, so that the HSV color space of the input signals has a cylindrical shape, that is, the same shape as a cylindrical part of the extended HSV color space.

Next, the signal processing unit 20 calculates the output signal (signal value $X_{1-(p,\ q)}$) of the first sub-pixel 49R based on at least the converted input signal Ra (signal value $x_{1-(p,\ q)}$) of the first sub-pixel 49R and an expansion coefficient α, and outputs the result to the first sub-pixel 49R. The signal processing unit 20 also calculates the output signal (signal value $X_{2-(p,\ q)}$) of the second sub-pixel 49G based on at least the converted input signal Ga (signal value $x_{2-(p,\ q)}$) of the second sub-pixel 49G and the expansion coefficient α, and outputs the result to the second sub-pixel 49G. The signal processing unit 20 also calculates the output signal (signal value $X_{3-(p,\ q)}$) of the third sub-pixel 49B based on at least the converted input signal Ba (signal value $x_{3-(p,\ q)}$) of the third sub-pixel 49B and the expansion coefficient α, and outputs the result to the third sub-pixel 49B. The signal processing unit 20 further calculates the output signal (signal value $X_{4-(p,\ q)}$) of the fourth sub-pixel 49W based on the converted input signal Ra (signal value $x_{1-(p,\ q)}$) of the first sub-pixel 49R, the converted input signal Ga (signal value $x_{2-(p,\ q)}$) of the second sub-pixel 49G, and the converted input signal Ba (signal value $x_{3-(p,\ q)}$) of the third sub-pixel 49B, and outputs the result to the fourth sub-pixel 49W.

Specifically, the signal processing unit 20 calculates the output signal of the first sub-pixel 49R based on the expansion coefficient α of the first sub-pixel 49R and the output signal of the fourth sub-pixel 49W, calculates the output signal of the second sub-pixel 49G based on the expansion coefficient α of the second sub-pixel 49G and the output signal of the fourth sub-pixel 49W, and calculates the output signal of the third sub-pixel 49B based on the expansion coefficient α of the third sub-pixel 49B and the output signal of the fourth sub-pixel 49W.

That is, assuming that χ is a constant depending on the display device 10, the signal processing unit 20 obtains, from the following expressions (1) to (3), the signal value $X_{1-(p,\ q)}$ as the output signal of the first sub-pixel 49R, the signal value $X_{2-(p,\ q)}$ as the output signal of the second sub-pixel 49G, and the signal value $x_{3-(p,\ q)}$ as the output signal of the third sub-pixel 49B, each of those signal values being output to the (p, q)-th pixel (or a group of the first sub-pixel 49R, the second sub-pixel 49G, and the third sub-pixel 49B).

$$X_{1-(p,q)}=\alpha x_{1-(p,q)}-\chi X_{4-(p,q)} \tag{1}$$

$$X_{2-(p,q)}=\alpha x_{2-(p,q)}-\chi X_{4-(p,q)} \tag{2}$$

$$X_{3-(p,q)}=\alpha x_{3-(p,q)}-\chi X_{4-(p,q)} \tag{3}$$

The signal processing unit 20 obtains the maximum value Vmax(S) of the brightness using the saturation S as a variable in the HSV color space expanded by adding the fourth color, obtains the saturation S and the brightness V(S) in the pixels based on the input signal values of the sub-pixels in the pixels, and determines the expansion coefficient α so that a ratio of a pixel in which an expanded value of the brightness obtained by multiplying the brightness V(S) by the expansion coefficient α exceeds the maximum value Vmax(S) to all the pixels is equal to or smaller than a limit value β (Limit value). The limit value β is a value (ratio) of the upper limit of the ratio of a width exceeding the maximum value of the brightness in the extended HSV color space to the maximum value in combinations of values of the hue H and the saturation S.

As described above, the saturation S and the brightness V(S) are expressed as follows: S=(Max−Min)/Max, and V(S)=Max. The saturation S may take values of 0 to 1, the brightness V(S) may take values of 0 to $(2^n-1)$, and n is a display gradation bit number. Max is the maximum value among the input signal values of three sub-pixels, that is, the input signal value of the first sub-pixel, the input signal value of the second sub-pixel, and the input signal value of the third sub-pixel, each of those signal values being input to the pixel. Min is the minimum value among the input signal values of three sub-pixels, that is, the input signal value of the first sub-pixel, the input signal value of the second sub-pixel, and the input signal value of the third sub-pixel, each of those signal values being input to the pixel. A hue H is represented in a range of 0° to 360° as illustrated in FIG. 8. Arranged are red, yellow, green, cyan, blue, magenta, and red from 0° to 360°. In the embodiment, a region including an angle 0° is red, a region including an angle 120° is green, and a region including an angle 240° is blue. The saturation S increases outward, like 0, 0.5, 0.8, and 1.

According to the embodiment, the signal value $X_{4-(p,\ q)}$ can be obtained based on a product of $Min_{(p,\ q)}$ and the expansion coefficient $\alpha$. Specifically, the signal value $X_{4-(p,\ q)}$ can be obtained based on the following expression (4). In the expression (4), the product of $Min_{(p,\ q)}$ and the expansion coefficient $\alpha$ is divided by $\chi$. However, the embodiment is not limited thereto. $\chi$ will be described later. The expansion coefficient $\alpha$ is determined for each image display frame.

$$X_{4-(p,q)}=Min_{(p,q)}\cdot\alpha/\chi \tag{4}$$

Generally, in the (p, q)-th pixel, the saturation $S_{(p,\ q)}$ and the brightness $V(S)_{(p,\ q)}$ in the cylindrical HSV color space can be obtained from the following expressions (5) and (6) based on the input signal (signal value $x_{1-(p,\ q)}$) of the first sub-pixel 49R, the input signal (signal value $x_{2-(p,\ q)}$) of the second sub-pixel 49G, and the input signal (signal value $x_{3-(p,\ q)}$) of the third sub-pixel 49B.

$$S_{(p,q)}=(Max_{(p,q)}-Min_{(p,q)})/Max_{(p,q)} \tag{5}$$

$$V(S)_{(p,q)}=Max_{(p,q)} \tag{6}$$

In the above expressions, $Max_{(p,\ q)}$ represents the maximum value among the input signal values of three sub-pixels 49 ($x_{1-(p,\ q)}$, $x_{2-(p,\ q)}$, and $x_{3-(p,\ q)}$), and $Min_{(p,\ q)}$ represents the minimum value among the input signal values of three sub-pixels 49 ($x_{1-(p,\ q)}$, $x_{2-(p,\ q)}$, and $x_{3-(p,\ q)}$). In the embodiment, n is assumed to be 8. That is, the display gradation bit number is assumed to be 8 bits (a value of the display gradation is assumed to be 256 gradations, that is, 0 to 255).

No color filter is arranged for the fourth sub-pixel 49W that displays white. When a signal having a value corresponding to the maximum signal value of the output signal of the first sub-pixel is input to the first sub-pixel 49R, a signal having a value corresponding to the maximum signal value of the output signal of the second sub-pixel is input to the second sub-pixel 49G, and a signal having a value corresponding to the maximum signal value of the output signal of the third sub-pixel is input to the third sub-pixel 49B, luminance of an aggregate of the first sub-pixel 49R, the second sub-pixel 49G, and the third sub-pixel 49B included in the pixel 48 or a group of pixels 48 is assumed to be $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is assumed to be $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Assuming that $\chi$ is a constant depending on the display device 10, the constant $\chi$ is represented by $\chi=BN_4/BN_{1-3}$.

Specifically, the luminance $BN_4$ when the input signal having a value of display gradation 255 is assumed to be input to the fourth sub-pixel 49W is 1.5 times the luminance $BN_{1-3}$ of white when it is assumed that the input signals having values of display gradation such as the signal value $x_{1-(p,\ q)}=255$, the signal value $x_{2-(p,\ q)}=255$, and the signal value $x_{3-(p,\ q)}=255$, are input to the aggregate of the first sub-pixel 49R, the second sub-pixel 49G, and the third sub-pixel 49B. That is, $\chi$ is 1.5 in the embodiment.

If the signal value $x_{4-(p,\ q)}$ is given by the expression (4) above, Vmax(S) can be represented by the following expressions (7) and (8).

When $S\leq S_0$, $$Vmax(S)=(\chi+1)\cdot(2^n-1) \tag{7}$$

When $S_0<S\leq 1$, $$Vmax(S)=(2^n-1)\cdot(1/S) \tag{8}$$

In this case, $S_0=1/(\chi+1)$ is satisfied.

The thus obtained maximum value Vmax(S) of the brightness using the saturation S as a variable in the HSV color space expanded by adding the fourth color component is stored in the signal processing unit 20 as a kind of look-up table, for example. Alternatively, the signal processing unit 20 obtains the maximum value Vmax(S) of the brightness using the saturation S as a variable in the expanded HSV color space as occasion demands.

Next, the following describes a method of obtaining the signal values $X_{1-(p,\ q)}$, $X_{2-(p,\ q)}$, $X_{3-(p,\ q)}$, and $X_{4-(p,\ q)}$ as output signals of the (p, q)-th pixel 48 (expansion processing). The following processing is performed to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed to also keep (maintain) color tone. In addition, the processing is performed to keep (maintain) a gradation-luminance characteristic (gamma characteristic, $\gamma$ characteristic). When all of the input signal values are 0 or smaller values in any one of the pixels 48 or a group of the pixels 48, the expansion coefficient $\alpha$ may be obtained without including such pixel 48 or a group of pixels 48.

First Process

First, the signal processing unit 20 obtains the saturation S and the brightness V(S) in the pixels 48 based on the input signal values of the sub-pixels 49 of the pixels 48. Specifically, $S_{(p,\ q)}$ and $V(S)_{(p,\ q)}$ are obtained from the expressions (5) and (6) based on the signal value $x_{1-(p,\ q)}$ that is the input signal of the first sub-pixel 49R, the signal value $x_{2-(p,\ q)}$ that is the input signal of the second sub-pixel 49G, and the signal value $x_{3-(p,\ q)}$ that is the input signal of the third sub-pixel 49B, each of those signal values being input to the (p, q)-th pixel 48. The signal processing unit 20 performs this processing on all of the pixels 48.

Second Process

Next, the signal processing unit 20 obtains the expansion coefficient $\alpha(S)$ based on the Vmax(S)/V(S) obtained in the pixels 48.

$$\alpha(S)=Vmax(S)/V(S) \tag{9}$$

Then arranged are values of expansion coefficient $\alpha(S)$ obtained in the pixels (all of $P_0\times Q_0$ pixels in the embodiment) 48 in ascending order, for example, and it is assumed that the expansion coefficient $\alpha(S)$ corresponding to a range from the minimum value to $\beta\times P_0\times Q_0$ is the expansion coefficient $\alpha$ among the values of the $P_0\times Q_0$ expansion coefficients $\alpha(S)$. In this way, the expansion coefficient $\alpha$ can be determined so that a ratio of the pixel in which the expanded value of the brightness obtained by multiplying the brightness V(S) by the expansion coefficient $\alpha$ exceeds the maximum value Vmax(S) to all the pixels is equal to or smaller than a predetermined value ($\beta$).

Third Process

Next, the signal processing unit 20 obtains the signal value $X_{4-(p,\ q)}$ in the (p, q)-th pixel 48 based on at least the signal value $x_{1-(p,\ q)}$, the signal value $x_{2-(p,\ q)}$, and the signal value $x_{3-(p,\ q)}$ of the input signals. In the embodiment, the signal processing unit 20 determines the signal value $X_{4-(p,\ q)}$ based on $Min_{(p,\ q)}$, the expansion coefficient $\alpha$, and the constant $\chi$. More specifically, as described above, the signal processing unit 20 obtains the signal value $X_{4-(p,\ q)}$ based on the expression (4). The signal processing unit 20 obtains the signal value $X_{4-(p,\ q)}$ for all of the $P_0 \times Q_0$ pixels 48.

Fourth Process

Subsequently, the signal processing unit 20 obtains the signal value $X_{1-(p,\ q)}$ in the (p, q)-th pixel 48 based on the signal value $x_{1-(p,\ q)}$, the expansion coefficient α, and the signal value $X_{4-(p,\ q)}$, obtains the signal value $X_{2-(p,\ q)}$, in the (p, q)-th pixel 48 based on the signal value $x_{2-(p,\ q)}$, the expansion coefficient α, and the signal value $X_{4-(p,\ q)}$, and obtains the signal value $X_{3-(p,\ q)}$ in the (p, q)-th pixel 48 based on the signal value $x_{3-(p,\ q)}$, the expansion coefficient α, and the signal value $X_{4-(p,\ q)}$. Specifically, the signal processing unit 20 obtains the signal value $x_{1-(p,\ q)}$, the signal value $X_{2-(p,\ q)}$, and the signal value $X_{3-(p,\ q)}$ in the (p, q)-th pixel 48 based on the expressions (1) to (3) described above.

The signal processing unit 20 expands a value of $Min_{(p,\ q)}$ with α as represented by the expression (4). In this way, the value of $Min_{(p,\ q)}$ is expanded by α, so that the luminance of the white display sub-pixel (fourth sub-pixel 49W) increases, and the luminance of the red, green and blue display sub-pixels (corresponding to the first, the second, and the third sub-pixels 49R, 49G, and 49B, respectively) also increase as represented by the above expressions. Due to this, dullness of color can be prevented. That is, the luminance of the entire image is multiplied by α because the value of $Min_{(p,\ q)}$ is expanded by α, compared with the case in which the value of $Min_{(p,\ q)}$ is not expanded. Accordingly, for example, a static image and the like can be preferably displayed with high luminance.

The luminance displayed by the output signals $X_{1-(p,\ q)}$, $X_{2-(p,\ q)}$, $X_{3-(p,\ q)}$, and $X_{4-(p,\ q)}$ in the (p, q)-th pixel 48 is expanded α times the luminance formed by the input signals $x_{1-(p,\ q)}$, $x_{2-(p,\ q)}$ and $x_{3-(p,\ q)}$. Accordingly, the display device 10 may reduce the luminance of the surface light source device 50 based on the expansion coefficient α so as to cause the luminance to be the same as that of the pixel 48 that is not expanded. Specifically, the luminance of the surface light source device 50 may be multiplied by (1/α).

As described above, the display device 10 according to the embodiment sets the limit value (Limit value) β for each frame of the input signals so as to set the expansion coefficient to a value that allows power consumption to be reduced while maintaining the display quality.

Saturation Conversion Processing of Input Signals

Figure 9:
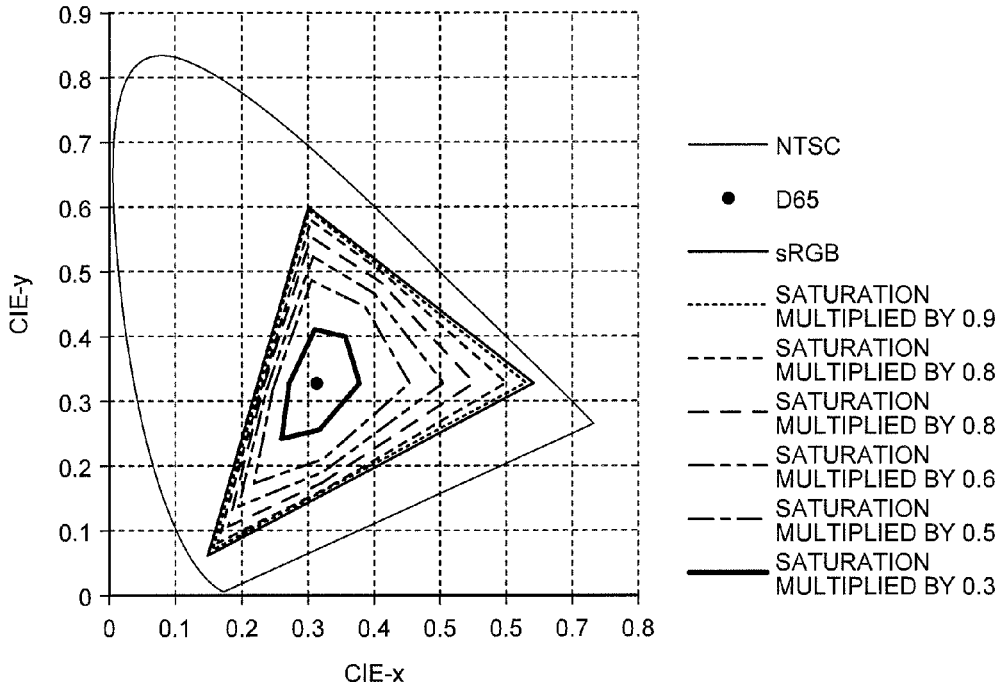
FIG. 9 is a diagram for explaining a color gamut depending on a saturation reduction ratio.

FIG. 9 is a diagram for explaining a color gamut depending on a saturation reduction ratio. It is found that, if the saturation conversion processing unit 222 illustrated in FIG. 6 uniformly multiplies the saturation S of the input signals by the gain value Sgain, the color gamut is narrowed by the processing in the data conversion unit 24 as illustrated in FIG. 9. In the case of a single color with a display gradation value of 255, the saturation conversion is performed so that the white component increases and the saturation decreases, but the color gamut is narrowed. In the embodiment, a description will be made of a processing method with which the narrowing of the color gamut can be suppressed even when the saturation conversion processing unit 222 performs the conversion processing to reduce the saturation from that of the input signal values.

As described above, the saturation S is represented such that S=(Max−Min)/Max, and a condition for the saturation S to be 1 is represented such that Min=0. When the saturation conversion processing unit 222 performs the conversion processing to reduce the saturation S, the saturation conversion processing unit 222 can suppress the narrowing of the color gamut by setting the gain value Sgain according to the value of Min. The gain value Sgain can be represented by the following expression (10).

$$Sgain=(Sparam-1)\times Min+1 \tag{10}$$

Figure 10:
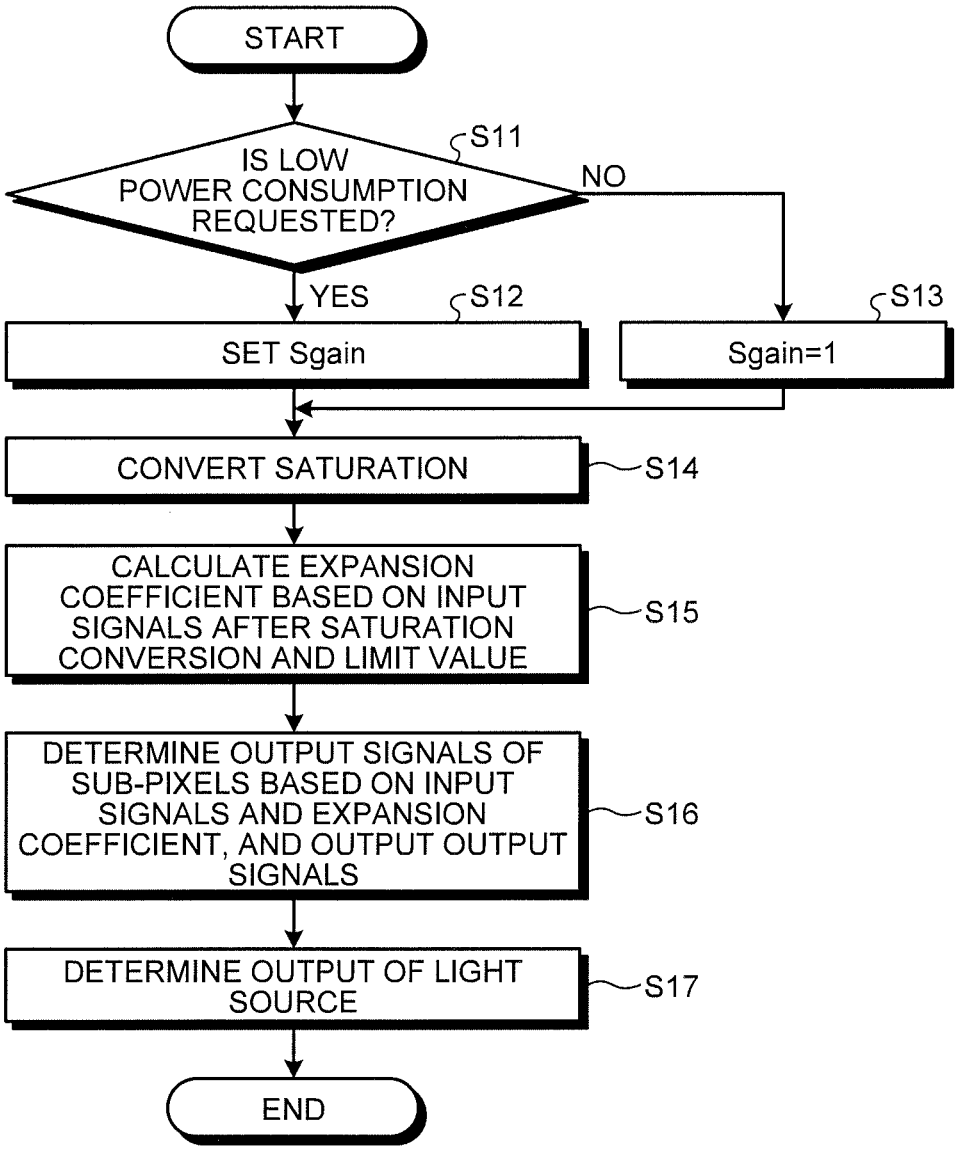
FIG. 10 is a flowchart for explaining a processing procedure of color conversion processing according to the embodiment.
Figure 11:
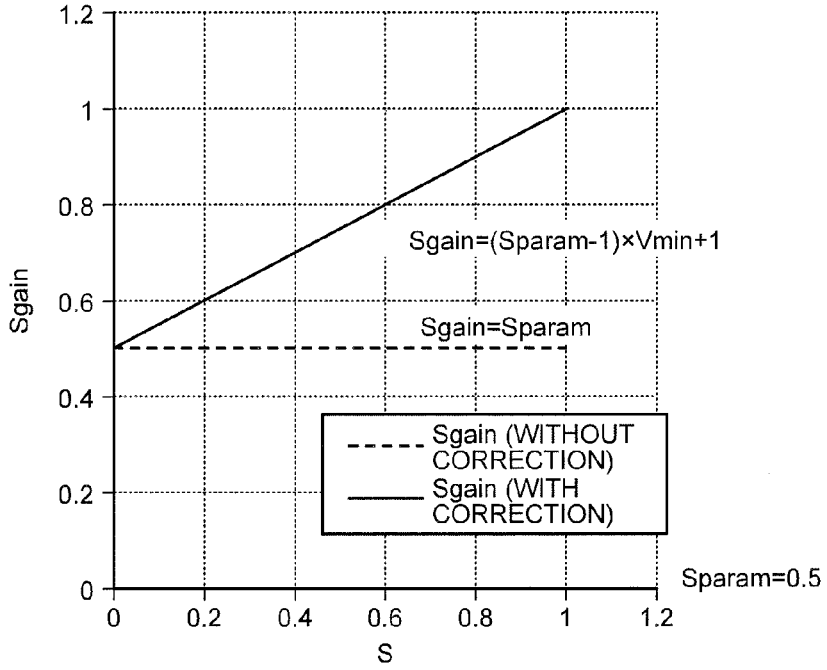
FIG. 11 is an explanatory diagram illustrating a relation of saturation after conversion to saturation of input values.
Figure 12:
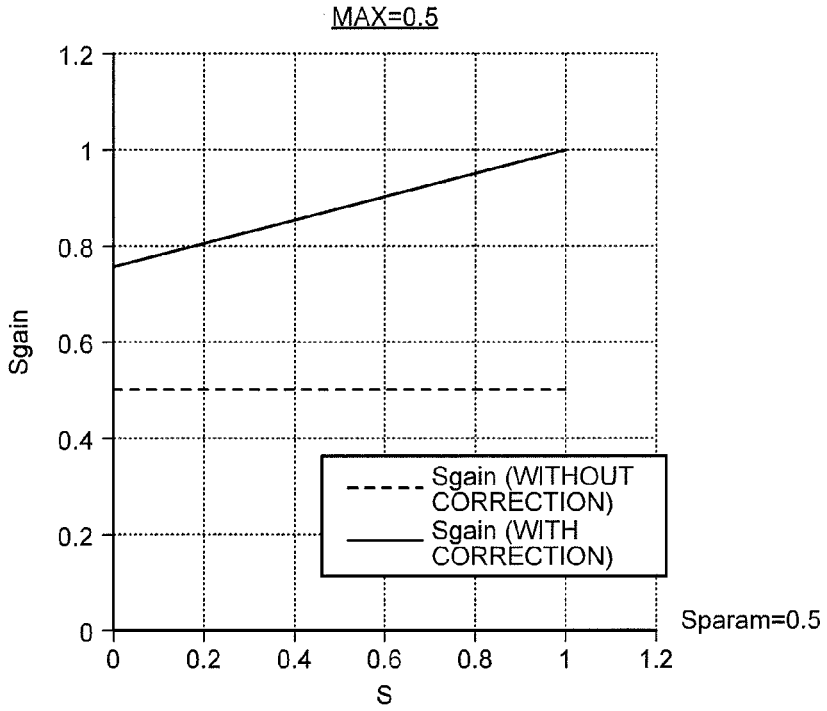
FIG. 12 is an explanatory diagram illustrating the relation of the saturation after conversion to the saturation of the input values.
Figure 13:
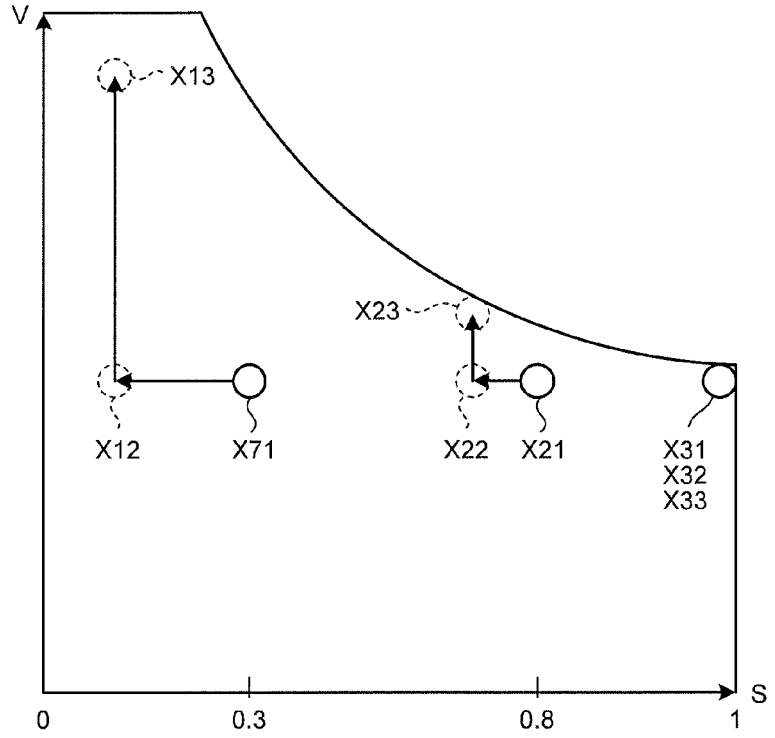
FIG. 13 is a diagram illustrating a relation between expanded values obtained by expanding converted input signals and an HSV color space according to the embodiment.

Sparam is a set value set by the saturation conversion setting unit 223. The set value Sparam is given such that 0≤Sparam<1, and is, for example, stored in the saturation conversion setting unit 223. FIG. 10 is a flowchart for explaining a processing procedure of the color conversion processing according to the embodiment. FIG. 11 is an explanatory diagram illustrating a relation of the saturation after conversion to the saturation of the input values. FIG. 12 is an explanatory diagram illustrating the relation of the saturation after conversion to the saturation of the input values. FIG. 13 is a diagram illustrating a relation between expanded values obtained by expanding the converted input signals and the HSV color space according to the embodiment.

As illustrated in FIG. 10, if the signal processing unit 20 accepts a request for low power consumption (Yes at Step S11), the saturation conversion unit 22 reads Sparam stored in the saturation conversion setting unit 223 (Step S12), and multiplies the gain value Sgain obtained based on the expression (10) by the saturation S. The RGB conversion unit 224 converts the hue H, the brightness V(S), and the saturation S that has been processed by the saturation conversion processing unit 222 into the converted input signal Ra of the first sub-pixel 49R the signal value of which is $x_{1-(p,\ q)}$, the converted input signal Ga of the second sub-pixel 49G the signal value of which is $x_{2-(p,\ q)}$, and the converted input signal Ba of the third sub-pixel 49B the signal value of which is $x_{3-(p,\ q)}$. Thus, the signal processing unit 20 performs the saturation conversion processing (Step S14). In the embodiment, the signal processing unit 20 accepts the request for low power consumption at Step S11. The request may, however, be a request for luminance improvement.

As illustrated in FIG. 11, suppose a case in which Max is 1, the set value Sparam is 0.5, and the gain value Sgain is not a function of Min (illustrated as Sgain without correction in FIG. 11). In this case, the saturation S of the input signals is uniformly multiplied by the gain value Sgain (=Sparam=0.5), and in the case of a single color with a display gradation value of 255, the saturation conversion is performed so that the white component increases and the saturation decreases, but the color gamut is narrowed. In contrast, as illustrated in FIG. 11, suppose a case in which Max is 1, the set value Sparam is 0.5, and the gain value Sgain is based on the expression (10) (illustrated as Sgain with correction in FIG. 11). In this case, the gain value Sgain comes closer to 1 as the saturation S of the input signals comes closer to 1, so that, in the case of a single color with a display gradation value of 255, the reduction in the saturation is suppressed, and the color gamut is maintained. If Max is 0.5 and the set value Sparam is 0.5, the gain value Sgain based on the expression (10) is also influenced by the value of Max, as illustrated in FIG. 12, because the value of Min does not exceed the value of Max.

As illustrated in FIG. 13, when the saturation S is close to 1, the amount of reduction in the saturation is suppressed even after the saturation is converted by the saturation conversion setting unit 223, so that the amount of conversion from a position X31 of an input value supplied to the saturation conversion setting unit 223 in the HSV space is small as indicated by a position X32 in the HSV space. Due to this, even when the data conversion unit 24 widens the dynamic range of the brightness in the HSV color space (extended HSV color space), the color is simply positioned in a position X33 in the HSV space, and the narrowing of the color gamut is suppressed.

As illustrated in FIG. 13, when the saturation S is close to 0.8, the amount of reduction in the saturation is suppressed even after the saturation is converted by the saturation conversion setting unit 223, so that the amount of conversion from a position X21 of an input value supplied to the saturation conversion setting unit 223 in the HSV space is small as indicated by a position X22 in the HSV space. Due to this, even when the data conversion unit 24 widens the dynamic range of the brightness in the HSV color space (extended HSV color space), the color is simply positioned in a position X23 in the HSV space, and the narrowing of the color gamut is suppressed.

As illustrated in FIG. 13, when the saturation S is close to 0.3, the saturation is converted by the saturation conversion setting unit 223, and the amount of conversion from a position X11 of an input value supplied to the saturation conversion setting unit 223 in the HSV space is large as indicated by a position X12 in the HSV space. Due to this, the data conversion unit 24 widens the dynamic range of the brightness in the HSV color space (extended HSV color space), and the color is positioned in a position X13 in the HSV space.

As illustrated in FIG. 10, if the signal processing unit 20 does not accept the request for low power consumption (No at Step S11), the saturation conversion unit 22 reads the set value Sparam (Sparam=1) stored in the saturation conversion setting unit 223 (Step S13), and multiplies the gain value Sgain (=1) obtained based on the expression (10) by the saturation S (Step S14). Although the signal processing unit 20 performs the saturation conversion processing (Step S14), the saturation S does not change.

The signal processing unit 20 calculates the expansion coefficient α based on the input signals, that is, the converted input signal Ra of the first sub-pixel 49R the signal value of which is $x_{1-(p,q)}$, the converted input signal Ga of the second sub-pixel 49G the signal value of which is $x_{2-(p,q)}$, and the converted input signal Ba of the third sub-pixel 49B the signal value of which is $x_{3-(p,q)}$, and on the limit value β (Limit value) (Step S15). The signal processing unit 20 then determines the output signals of the sub-pixels 49 in all the pixels 48 based on the input signals and the expansion coefficient, and outputs the output signals (Step S16). As a result, the signal processing unit 20 can widen the dynamic range of the brightness in the HSV color space (extended HSV color space) as described above.

Subsequently, the signal processing unit 20 further determines an output from the light source (Step S17). That is, the signal processing unit 20 outputs the expanded output signal to the image display panel drive circuit 40, and outputs an output condition of a surface light source (surface light source device 50) that is calculated corresponding to an expansion result to the surface light source device control circuit 60 as a surface light source device control signal.

As has been described above, the signal processing unit 20 according to the embodiment generates the converted input signals (such as the converted input signals Ra, Ga, and Ba) that have been changed so as to reduce the saturation S among the input signals, and calculates the output signals of the first sub-pixel 49R, the second sub-pixel 49G, and the third sub-pixel 49B based on the converted input signals (such as the converted input signals Ra, Ga, and Ba) and the expansion coefficient α that is a function of the amount of increase in brightness caused by the fourth sub-pixel. As a result, the expansion coefficient α can be increased by an amount corresponding to the reduction in the saturation S, so that the power consumption of the display device 10 is suppressed.

As described above, the converted input signals (such as the converted input signals Ra, Ga, and Ba) are signals obtained by multiplying the saturation S of the input signals by the gain value Sgain, and the gain value Sgain is represented by the above expression (10) when the minimum value of the brightness of the input signals is denoted as Min and the set value is given such that 0≤Sparam<1. As a result, the gain value Sgain comes closer to 1 as the saturation S of the input signals comes closer to 1, so that, even in the case of a color component such as a single color with a display gradation value of 255, the reduction in the saturation is suppressed, and the color gamut is maintained. The gain value Sgain decreases as the saturation S of the input signals comes closer to 0, so that the saturation S of the converted input signals (such as the converted input signals Ra, Ga, and Ba) decreases to be lower than the saturation S of the input signals. As a result, in the second process described above, the expansion coefficient α(S) can be increased, and the value of $Min_{(p,q)}$ is expanded by α as represented by the expression (4). In this way, the value of $Min_{(p,q)}$ is expanded by α, so that the luminance of the white display sub-pixel (fourth sub-pixel 49W) increases, and the luminance of the red display sub-pixel, the green display sub-pixel, and the blue display sub-pixel (corresponding to the first sub-pixel 49R, the second sub-pixel 49G, and the third sub-pixel 49B, respectively) also increase as represented by the above expressions. The luminance is expanded to a times the luminance formed from the converted input signals. Consequently, the display device 10 only needs to reduce the luminance of the surface light source device 50 based on the expansion coefficient α so as to cause the luminance to be the same as that of the pixel 48 that is not expanded. Specifically, the luminance of the surface light source device 50 only needs to be multiplied by (1/α), so that the power consumption is further suppressed.

As described above, the gain value Sgain obtained by the above expression (10) is also influenced by the value of Max because the value of Min does not exceed the value of Max. The saturation S results in 0 when Max−Min=0. Hence, the saturation conversion processing unit 222 may calculate the gain value Sgain using the following expression (11) instead of the above expression (10).

$$Sgain = Sparam \times [1-(Max-Min)] \quad (11)$$

Figure 14:
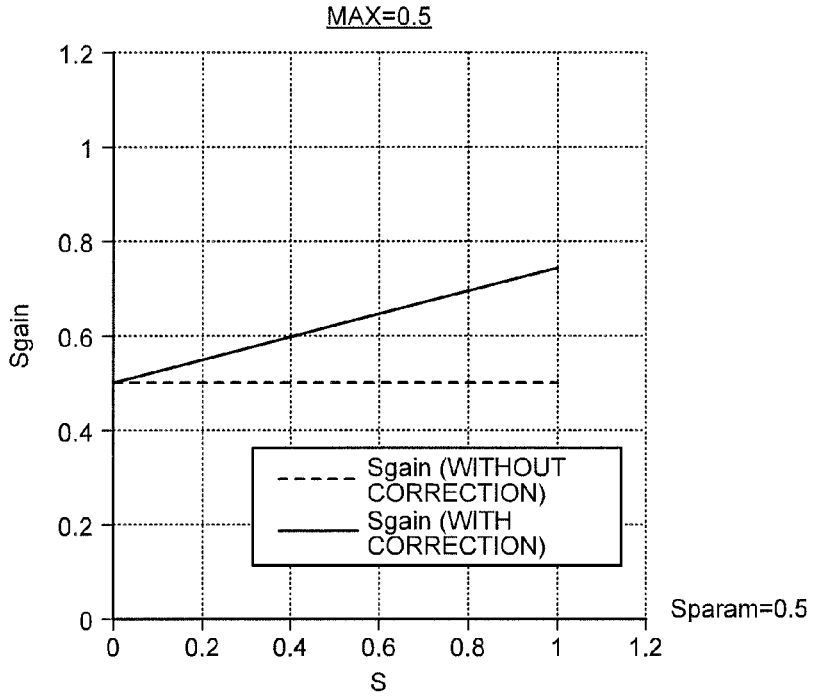
FIG. 14 is an explanatory diagram illustrating another relation of the saturation after conversion to the saturation of the input values.

As illustrated in FIG. 14, suppose a case in which Max is 0.5, the set value Sparam is 0.5, and the gain value Sgain is not a function of Min (illustrated as Sgain without correction in FIG. 14). In this case, the saturation S of the input signals is uniformly multiplied by the gain value Sgain (=Sparam=0.5), and in the case of a single color with a display gradation value of 255, the saturation conversion is performed so that the white component increases and the saturation decreases, but the color gamut is narrowed. In contrast, as illustrated in FIG. 14, suppose a case in which Max is 0.5, the set value Sparam is 0.5, and the gain value Sgain is based on the expression (11) (illustrated as Sgain with correction in FIG. 14). In this case, the saturation S does not result in 0 when Max−Min=0. Suppose a case in which Max is 0.5, the set value Sparam is 0.5, and the gain value Sgain is based on the expression (10) (illustrated as Sgain with correction in FIG. 14). In this case, the gain value Sgain comes closer to 1 as the saturation S of the input signals comes closer to 1, so that, in the case of a single color with a display gradation value of 255, the reduction in the saturation is suppressed, and the color gamut is maintained.

As described above, the converted input signals (such as the converted input signals Ra, Ga, and Ba) are signals obtained by multiplying the saturation S of the input signals by the gain value Sgain, and the gain value Sgain is represented by the above expression (11) when the minimum value of the brightness of the input signals is denoted as Min and the set value is given such that 0≤Sparam<1. As a result, the gain value Sgain comes closer to 1 as the saturation S of the input signals comes closer to 1, so that, even in the case of a color component such as a single color with a display gradation value of 255, the reduction in the saturation is suppressed, and the color gamut is maintained. The gain value Sgain decreases as the saturation S of the input signals comes closer to 0, so that the saturation S of the converted input signals (such as the converted input signals Ra, Ga, and Ba) decreases to be lower than the saturation S of the input signals. As a result, in the second process described above, the expansion coefficient $\alpha(S)$ can be increased, and the value of $Min_{(p, q)}$ is expanded by $\alpha$ as represented by the expression (4). In this way, the value of $Min_{(p, q)}$ is expanded by $\alpha$, so that the luminance of the white display sub-pixel (fourth sub-pixel 49W) increases, and the luminance of the red display sub-pixel, the green display sub-pixel, and the blue display sub-pixel (corresponding to the first sub-pixel 49R, the second sub-pixel 49G, and the third sub-pixel 49B, respectively) also increase as represented by the above expressions. The luminance is expanded to $\alpha$ times the luminance formed from the converted input signals. Consequently, the display device 10 only needs to reduce the luminance of the surface light source device 50 based on the expansion coefficient $\alpha$ so as to cause the luminance to be the same as that of the pixel 48 that is not expanded. Specifically, the luminance of the surface light source device 50 only needs to be multiplied by $(1/\alpha)$, so that the power consumption is further suppressed.

Outdoor Mode

To improve visibility of the display device 10 in the outdoors, the signal processing unit 20 varies the expansion coefficient $\alpha$ for expanding the signals according to the brightness V of the input signals. Accordingly, the expansion coefficient $\alpha$ increases as the brightness V decreases, that is, as the gradation level decreases, and the expansion coefficient $\alpha$ decreases as the brightness V increases, that is, as the gradation level increases. As a result, the luminance on the low gradation side increases, and the visibility of the display device 10 in the outdoors is improved. The signal processing unit 20 performs the irradiation based on the expansion coefficient $\alpha$ without reducing the luminance of the surface light source device 50, and increases the luminance of the white display sub-pixel (fourth sub-pixel 49W). Regarding the signal processing unit 20 according to the embodiment, a case will be studied in which the expansion coefficient $\alpha$ is larger than 1, and is constant with respect to the saturation S.

As illustrated in FIG. 7, the HSV color space expanded by adding the fourth color component (white) has an upper limit value of the brightness connected to the maximum value Vmax(S) of the brightness using the saturation S as a variable. In contrast to the input signals (input values of the RGB data) that can be displayed with the first color component, the second color component, and the third color component in each of the pixels 48, the values after being expanded are such that, for example, the brightness V is increased by the expansion coefficient $\alpha$ (=2.0) that is constant with respect to the saturation S, but all gradation information exceeding the upper limit value of the brightness is lost, so that a gradation loss occurs.

Figure 15:
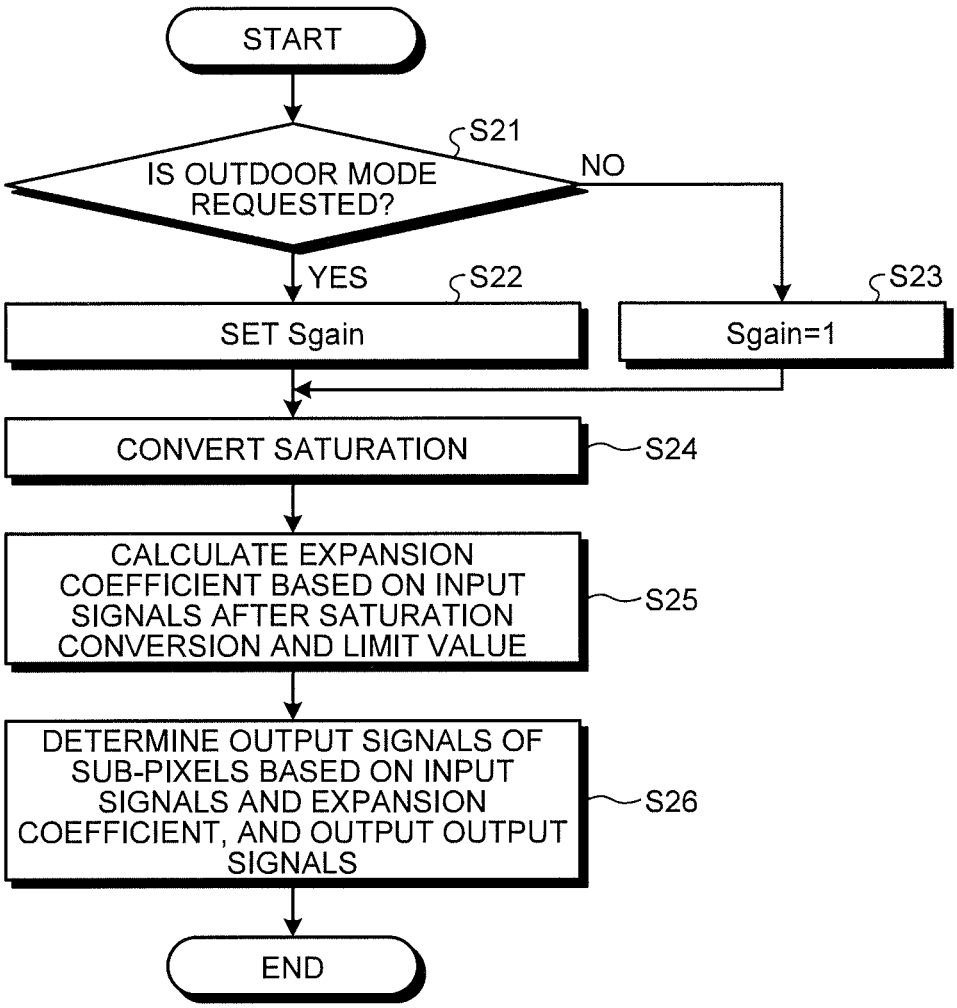
FIG. 15 is a flowchart for explaining a processing procedure of the color conversion processing according to the embodiment.
Figure 16:
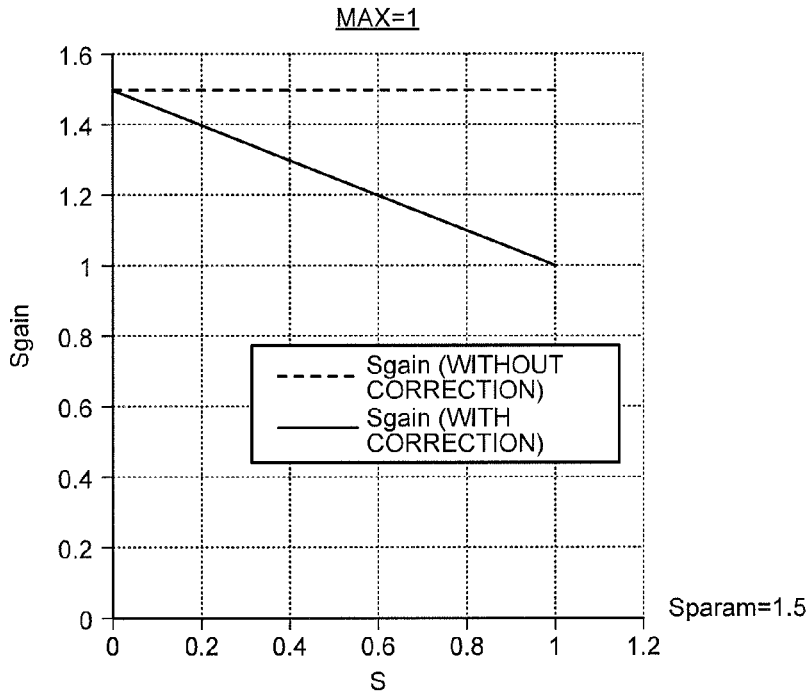
FIG. 16 is an explanatory diagram illustrating the relation of the saturation after conversion to the saturation of the input values.
Figure 17:
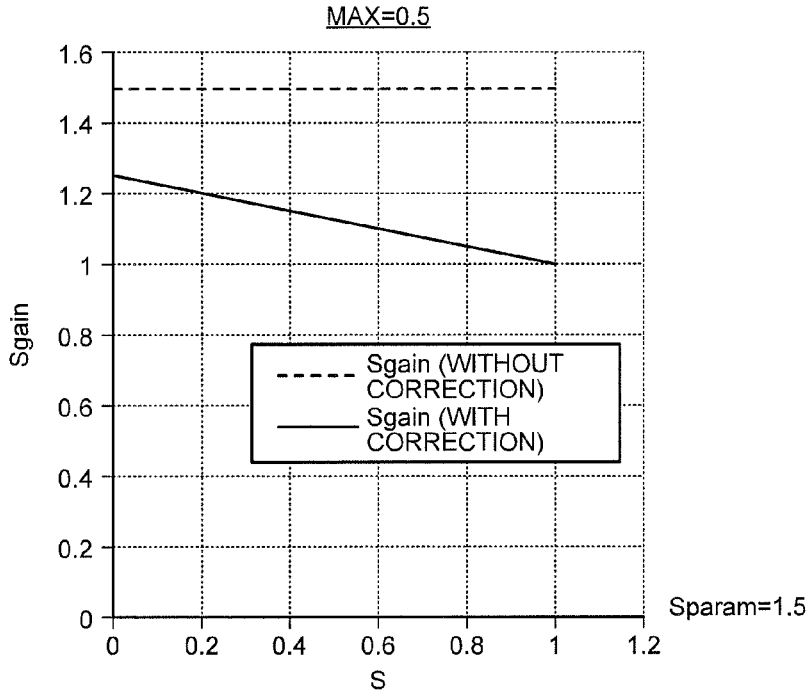
FIG. 17 is an explanatory diagram illustrating the relation of the saturation after conversion to the saturation of the input values.
Figure 18:
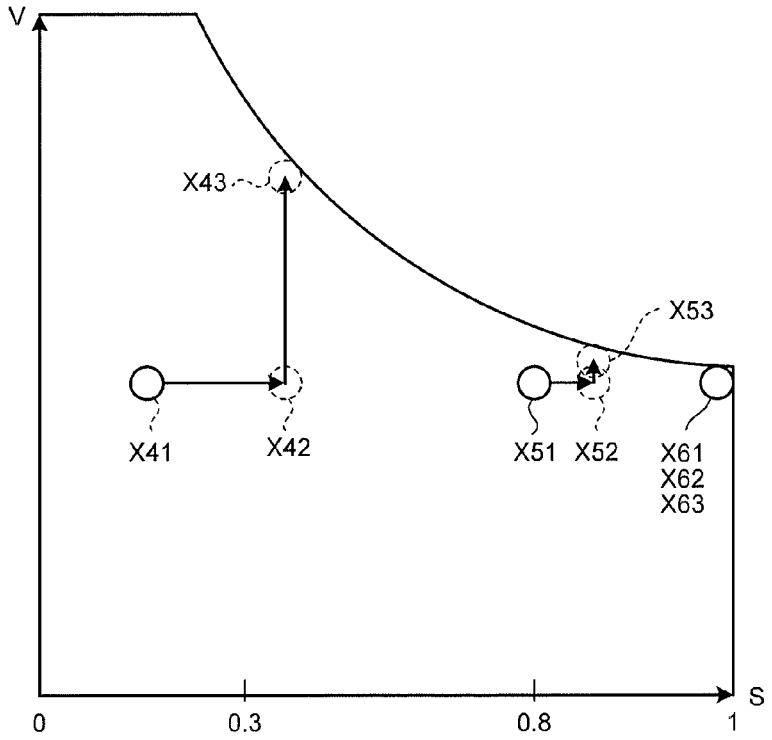
FIG. 18 is a diagram illustrating the relation between the expanded values obtained by expanding the converted input signals and the HSV color space according to the embodiment.
Figure 19:
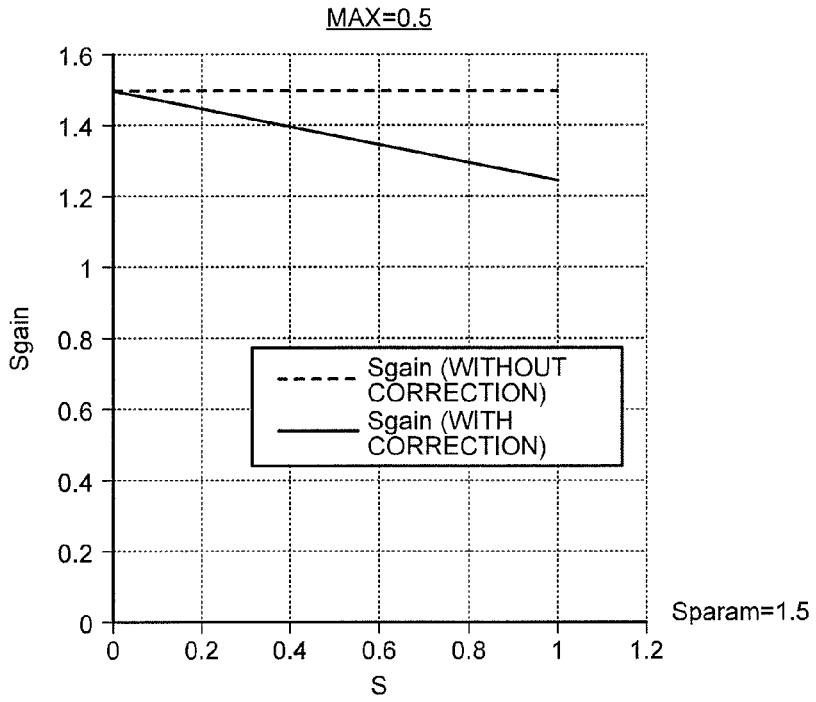
FIG. 19 is an explanatory diagram illustrating still another relation of the saturation after conversion to the saturation of the input values.

FIG. 15 is a flowchart for explaining a processing procedure of the color conversion processing according to the embodiment. FIG. 16 is an explanatory diagram illustrating the relation of the saturation after conversion to the saturation of the input values. FIG. 17 is an explanatory diagram illustrating the relation of the saturation after conversion to the saturation of the input values. FIG. 18 is a diagram illustrating the relation between the expanded values obtained by expanding the converted input signals and the HSV color space according to the embodiment. FIG. 19 is an explanatory diagram illustrating still another relation of the saturation after conversion to the saturation of the input values.

As illustrated in FIG. 15, if the signal processing unit 20 accepts a request for an outdoor mode (to improve visibility of the display device 10 in the outdoors) (Yes at Step S21), the saturation conversion unit 22 reads the set value Sparam given such that 0≤Sparam<1 that is stored in the saturation conversion setting unit 223 (Step S22), and multiplies the gain value Sgain obtained based on the expression (10) by the saturation S. The RGB conversion unit 224 converts the hue H, the brightness V(S), and the saturation S that has been processed by the saturation conversion processing unit 222 into the converted input signal Ra of the first sub-pixel 49R the signal value of which is $x_{1-(p, q)}$, the converted input signal Ga of the second sub-pixel 49G the signal value of which is $x_{2-(p, q)}$, and the converted input signal Ba of the third sub-pixel 49B the signal value of which is $x_{3-(p, q)}$. Thus, the signal processing unit 20 performs the saturation conversion processing (Step S24).

As illustrated in FIG. 15, if the signal processing unit 20 does not accept the request for the outdoor mode (No at Step S21), the saturation conversion unit 22 reads the set value Sparam (Sparam=1) stored in the saturation conversion setting unit 223 (Step S23), and multiplies the gain value Sgain (=1) obtained based on the expression (10) by the saturation S (Step S24). The processing of Step S23 may be replaced with the above-described processing of Step S12 illustrated in FIG. 10, such that the set value Sparam is read as Sparam given such that 0≤Sparam<1, and the gain value Sgain based on the expression (10) is multiplied by the saturation S.

Next, the signal processing unit 20 calculates the expansion coefficient $\alpha$ based on the input signals, that is, the converted input signal Ra of the first sub-pixel 49R the signal value of which is $x_{1-(p, q)}$, the converted input signal Ga of the second sub-pixel 49G the signal value of which is $x_{2-(p, q)}$, and the converted input signal Ba of the third sub-pixel 49B the signal value of which is $x_{3-(p, q)}$, and on the limit value $\beta$ (Limit value) (Step S25). The signal processing unit 20 then determines the output signals of the sub-pixels 49 in all the pixels 48 based on the input signals and the expansion coefficient, and outputs the output signals (Step S26).

As illustrated in FIG. 16, suppose a case in which Max is 1, the set value Sparam is 1.5, and the gain value Sgain is not a function of Min (illustrated as Sgain without correction with a dotted line in FIG. 16). In this case, the saturation S of the input signals is uniformly multiplied by the gain value Sgain (=Sparam=1.5), and in the case of a single color with a display gradation value of 255, the saturation conversion is performed so that the white component increases and the saturation decreases, but the gradation loss is likely to occur because the input signals are uniformly expanded by the expansion coefficient $\alpha$. In contrast, as illustrated in FIG. 16, suppose a case in which Max is 1, the set value Sparam is 1.5, and the gain value Sgain is based on the expression (10) (illustrated as Sgain with correction with a solid line in FIG. 16). In this case, the gain value Sgain comes closer to 1 as the saturation S of the input signals comes closer to 1, so that, in the case of a single color with a display gradation value of 255, the saturation increases, and the gradation loss is suppressed even if the input signals are expanded by the expansion coefficient α having a large value. If Max is 0.5 and the set value Sparam is 1.5, the gain value Sgain based on the expression (10) is also influenced by the value of Max, as illustrated in FIG. 17, because the value of Min does not exceed the value of Max.

As illustrated in FIG. 18, when the saturation is close to 1, the amount of reduction in the saturation is suppressed even after the saturation is converted by the saturation conversion setting unit 223, so that the amount of conversion from a position X61 of an input value supplied to the saturation conversion setting unit 223 in the HSV space is small as indicated by a position X62 in the HSV space. Due to this, even when the data conversion unit 24 widens the dynamic range of the brightness in the HSV color space (extended HSV color space), the color is simply positioned in a position X63 in the HSV space, and the gradation loss is suppressed.

As illustrated in FIG. 18, when the saturation is close to 0.8, the amount of reduction in the saturation is suppressed even after the saturation is converted by the saturation conversion setting unit 223, so that the amount of conversion from a position X51 of an input value supplied to the saturation conversion setting unit 223 in the HSV space is small as indicated by a position X52 in the HSV space. Due to this, even when the data conversion unit 24 widens the dynamic range of the brightness in the HSV color space (extended HSV color space), the color is simply positioned in a position X53 in the HSV space, and the gradation loss is suppressed.

As illustrated in FIG. 18, when the saturation is close to 0.3, the saturation is converted by the saturation conversion setting unit 223, and the amount of conversion from a position X41 of an input value supplied to the saturation conversion setting unit 223 in the HSV space is large as indicated by a position X42 in the HSV space. Due to this, the data conversion unit 24 widens the dynamic range of the brightness in the HSV color space (extended HSV color space), and the color is positioned in a position X43 in the HSV space. As a result, the visibility of the display device 10 in the outdoors is improved.

As has been described above, in the case of the outdoor mode (second display mode) in which the expansion coefficient α exceeds 1, the signal processing unit 20 generates the converted input signals (such as the converted input signals Ra, Ga, and Ba) that have been changed so as to increase the saturation S among the input signals, and calculates the output signals of the first sub-pixel 49R, the second sub-pixel 49G, and the third sub-pixel 49B based on the converted input signals (such as the converted input signals Ra, Ga, and Ba) and the expansion coefficient α that is the function of the amount of increase in brightness caused by the fourth sub-pixel. Even if the signal processing unit 20 expands the converted input values at the expansion coefficient α having a constant value exceeding 1, the brightness less often exceeds the upper limit value thereof, so that the loss of the gradation information decreases, and the occurrence of the gradation loss is suppressed.

If, for example, the surrounding area of the display device 10 is very bright, that is, if illuminance thereof is very high, the converted input signals (such as the converted input signals Ra, Ga, and Ba) differ from the input signals, but deterioration in display quality of the image display panel 30 included in the display device 10 is less visible. Accordingly, when the surrounding area of the display device 10 is very bright, the display device 10 can achieve high luminance display by using the outdoor mode (second display mode). As a result, the display device 10 can display images at high luminance when it is used at a very bright place, so that the visibility can be improved.

As described above, the converted input signals (such as the converted input signals Ra, Ga, and Ba) are signals obtained by multiplying the saturation S of the input signals by the gain value Sgain, and the gain value Sgain is represented by the above expression (10) when the minimum value of the brightness of the input signals is denoted as Min and the set value is given such that 1<Sparam. As a result, the gain value Sgain decreases to be closer to 1 as the saturation S of the input signals comes closer to 1, so that, even in the case of a color component such as a single color with a display gradation value of 255, the increase in the saturation is suppressed. The gain value Sgain increases as the saturation S of the input signals comes closer to 0, so that the saturation S of the converted input signals (such as the converted input signals Ra, Ga, and Ba) increases to be higher than the saturation S of the input signals. Even if the signal processing unit 20 expands the converted input values at the expansion coefficient α having a constant value exceeding 1, the increase in the saturation S less often causes the brightness to exceed the upper limit value thereof, so that the loss of the gradation information decreases, and the occurrence of the gradation loss is suppressed. A sufficient effect is provided if Sparam is given such that 1<Sparam≤3.5.

As described above, the gain value Sgain obtained by the above expression (10) is also influenced by the value of Max because the value of Min does not exceed the value of Max. The saturation S results in 0 when Max−Min=0. Hence, the saturation conversion processing unit 222 may calculate the gain value Sgain using the above expression (11) instead of the above expression (10), as illustrated in FIG. 19.

As described above, the converted input signals (such as the converted input signals Ra, Ga, and Ba) are signals obtained by multiplying the saturation S of the input signals by the gain value Sgain, and the gain value Sgain is represented by the above expression (11) when the minimum value of the brightness of the input signals is denoted as Min and the set value is given such that 1<Sparam. As a result, the gain value Sgain decreases to be closer to 1 as the saturation S of the input signals comes closer to 1, so that, even in the case of a color component such as a single color with a display gradation value of 255, the increase in the saturation is suppressed. The gain value Sgain increases as the saturation S of the input signals comes closer to 0, so that the saturation S of the converted input signals (such as the converted input signals Ra, Ga, and Ba) increases to be higher than the saturation S of the input signals. Even if the signal processing unit 20 expands the converted input values at the expansion coefficient α having a constant value exceeding 1, the increase in the saturation S less often causes the brightness to exceed the upper limit value thereof, so that the loss of the gradation information decreases, and the occurrence of the gradation loss is suppressed.

Figure 20:
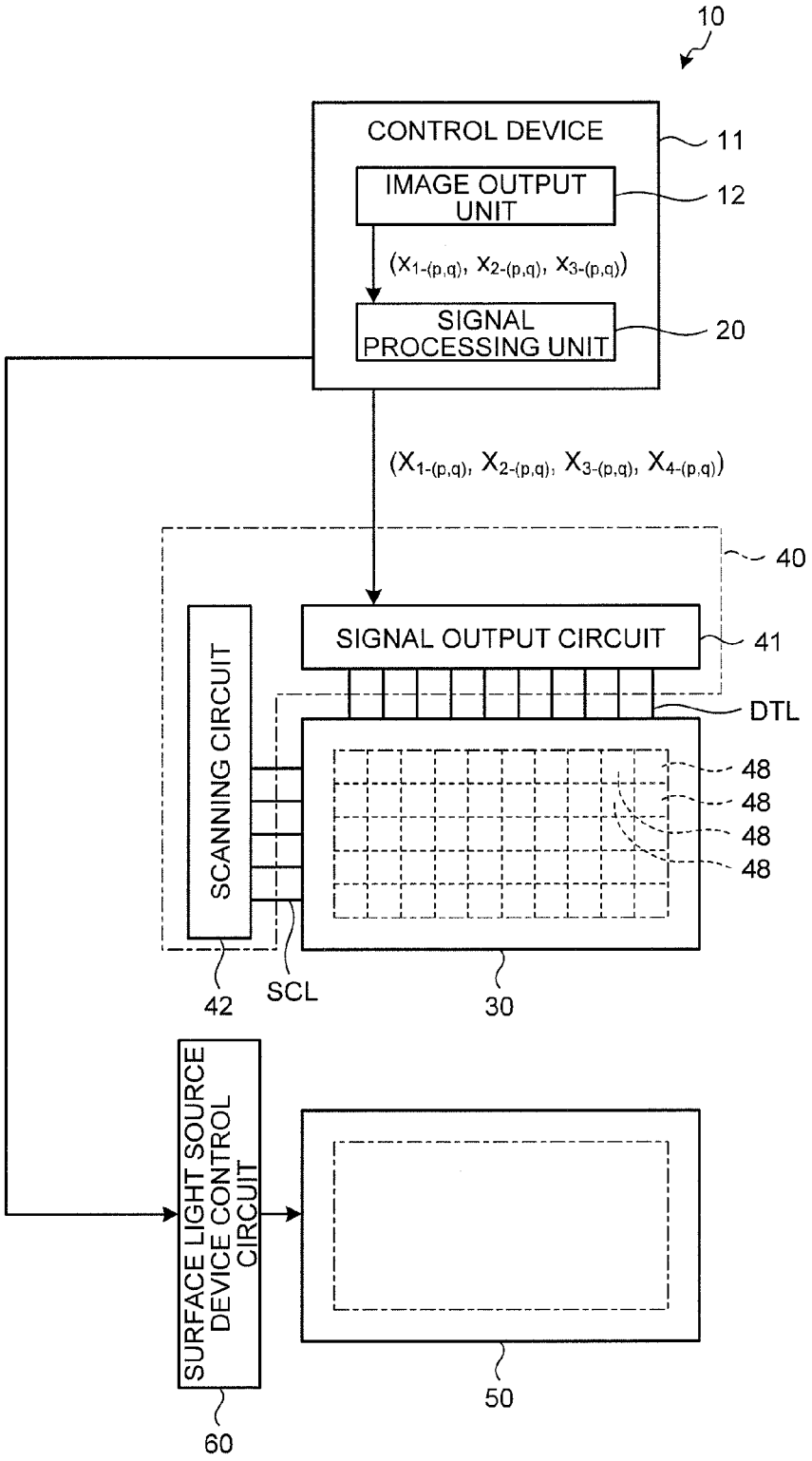
FIG. 20 is a block diagram illustrating another example of the configuration of the display device according to the embodiment.

FIG. 20 is a block diagram illustrating another example of the configuration of the display device according to the embodiment. As illustrated in FIG. 20, the signal processing unit 20 may be a part of the control device 11. If the signal processing unit 20 is a part of the control device 11, the signal processing unit 20 can perform the saturation conversion processing by only performing processing within the control device 11.

Figure 21:
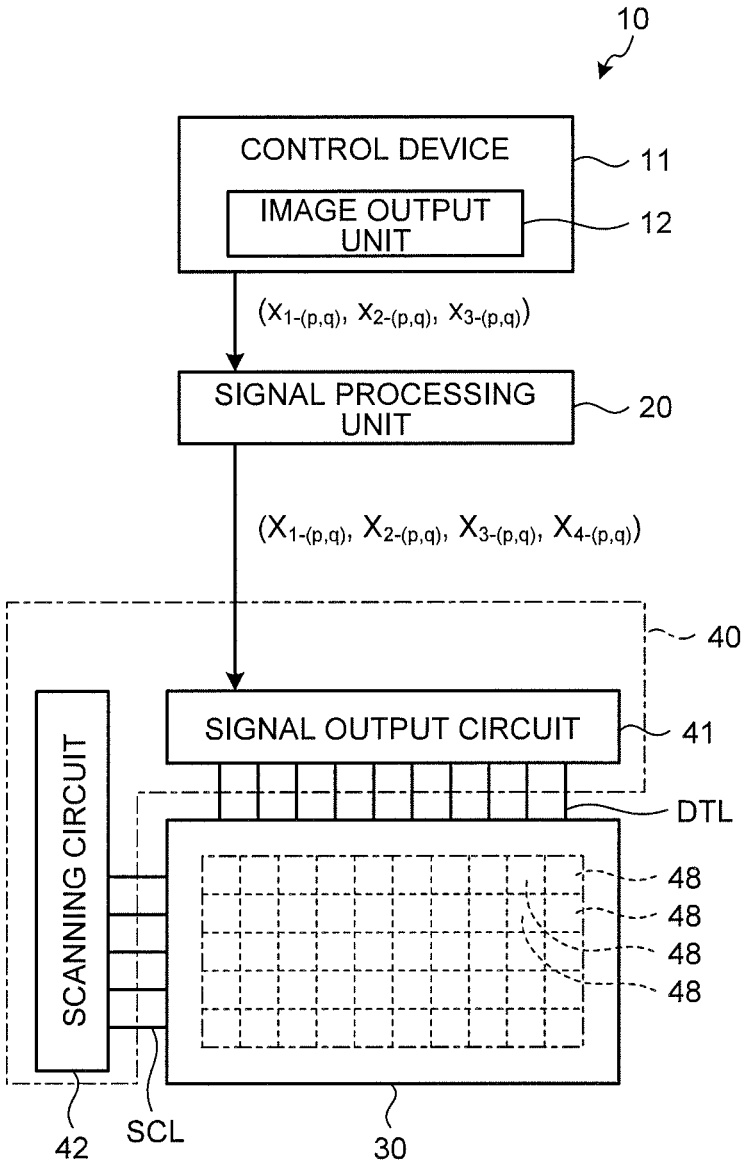
FIG. 21 is a block diagram illustrating still another example of the configuration of the display device according to the embodiment.
Figure 22:
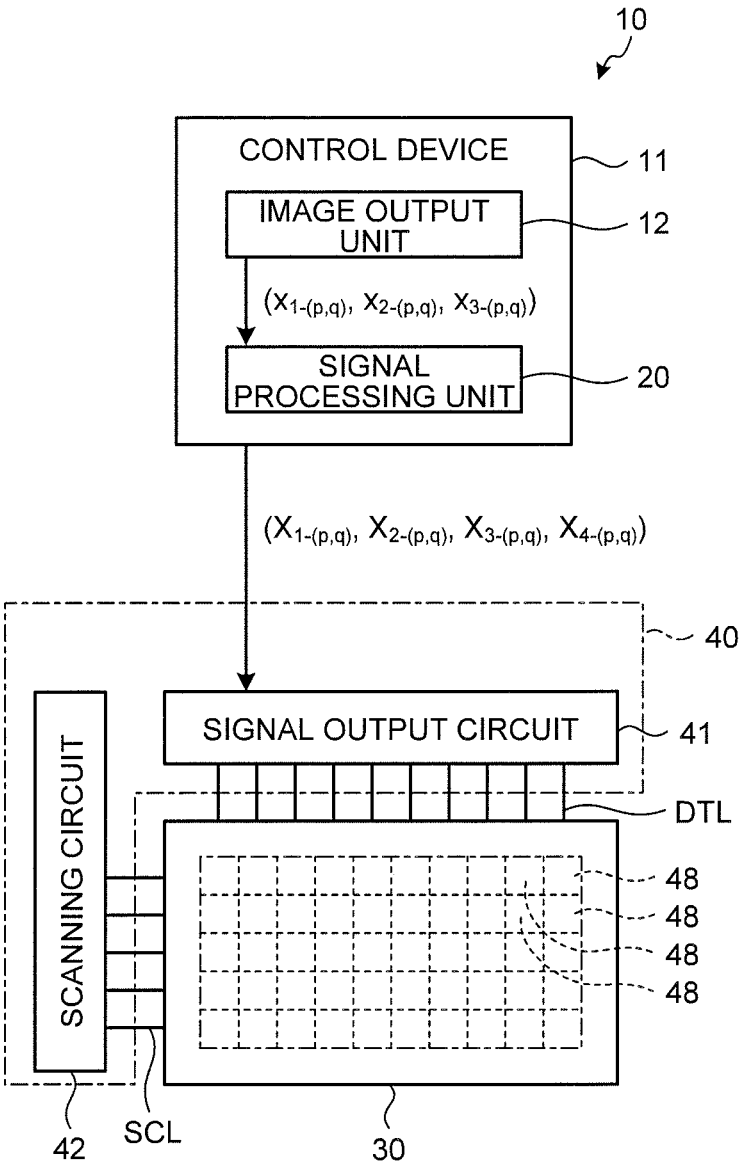
FIG. 22 is a block diagram illustrating still another example of the configuration of the display device according to the embodiment.

FIGS. 21 and 22 are block diagrams illustrating other examples of the configuration of the display device according to the embodiment. The display device 10 according to a modification of the embodiment illustrated in FIG. 21 includes the signal processing unit 20 that receives the input signals (RGB data) from the image output unit 12 of the control device 11 and executes the predetermined data conversion processing to output the processed signals, the image display panel 30 that displays an image based on the output signals output from the signal processing unit 20, and the image display panel drive circuit 40 that controls driving of the image display panel (display unit) 30. The display device 10 according to the modification of the embodiment is a reflective display device, which can display a video on the image display panel 30 using front light or environment light from the outside. The display device 10 according to another modification of the embodiment illustrated in FIG. 22 may include the signal processing unit 20 as a part of the control device 11 in the same manner as the signal processing unit 20 illustrated in FIG. 20. If the signal processing unit 20 is a part of the control device 11, the signal processing unit 20 can perform the saturation conversion processing by only performing processing within the control device 11.

Application Example

Figure 23:
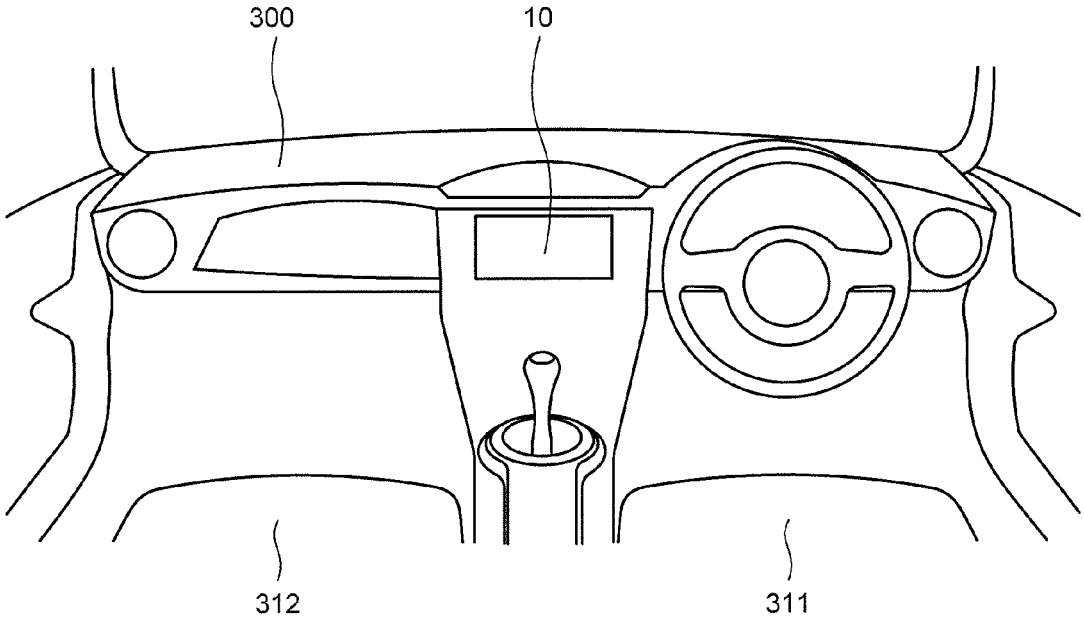
FIG. 23 is a diagram illustrating an example of an electronic apparatus including the display device according to the embodiment.
Figure 24:
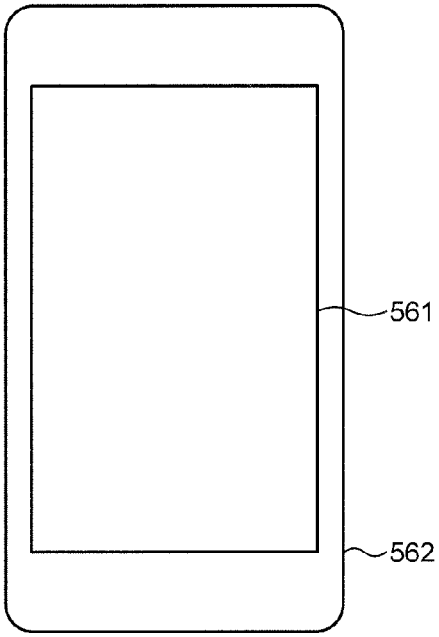
FIG. 24 is a diagram illustrating an example of the electronic apparatus including the display device according to the embodiment.

Next, the following describes an application example of the display device 10 described in the embodiment and the modification thereof with reference to FIGS. 23 and 24. FIGS. 23 and 24 are diagrams illustrating an example of an electronic apparatus to which the display device according to the embodiment is applied. The display device 10 according to the embodiment can be applied to electronic apparatuses in various fields such as a car navigation system illustrated in FIG. 23, a television apparatus, a digital camera, a notebook-type personal computer, a portable electronic apparatus such as a cellular telephone illustrated in FIG. 24, or a video camera. In other words, the display device 10 according to the embodiment can be applied to electronic apparatuses in various fields that display a video signal input from the outside or a video signal generated inside as an image or a video. The electronic apparatus includes the control device 11 (refer to FIG. 1) that supplies the video signal to the display device to control an operation of the display device.

The electronic apparatus illustrated in FIG. 23 is a car navigation device to which the display device 10 according to the embodiment and the modification thereof is applied. The display device 10 is arranged on a dashboard 300 in an automobile. Specifically, the display device 10 is arranged on the dashboard 300 and between a driver's seat 311 and a passenger seat 312. The display device 10 of the car navigation device is used for displaying navigation, displaying a music operation screen, or reproducing and displaying a movie.

The electronic apparatus illustrated in FIG. 24 is an information portable terminal, to which the display device 10 according to the embodiment and the modification thereof is applied, that operates as a portable computer, a multifunctional mobile phone, a mobile computer allowing a voice communication, or a communicable portable computer, and may be called a smartphone or a tablet terminal in some cases. This information portable terminal includes a display unit 561 on a surface of a housing 562, for example. The display unit 561 includes the display device 10 according to the embodiment and the modification thereof and a touch detection (what is called a touch panel) function that can detect an external proximity object.

The embodiment is not limited to the above description. The components according to the embodiment described above include a component that is easily conceivable by those skilled in the art, substantially the same component, and what is called an equivalent. The components can be variously omitted, replaced, and modified without departing from the gist of the embodiment described above.

According to the embodiment, the present disclosure includes the following aspects.

(X1) A display device including:

a display unit including pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit generates converted input signals with changed saturation among the input signals, and the signal processing unit calculates output signals to the first sub-pixel, the second sub-pixel, and the third sub-pixel based on the converted input signals and an amount of increase in brightness caused by the fourth sub-pixel.

(X2) The display device according to (X1), wherein the converted input signals are signals obtained by multiplying a saturation S of the input signals by a gain value Sgain, and when a minimum value of the brightness of the input signals is denoted as Min and a set value Sparam is given such that $0 \leq Sparam < 1$, the gain value Sgain is given by the following expression (1):

$$Sgain=(Sparam-1)\times Min+1 \quad (1).$$

(X3) The display device according to (X1), wherein the converted input signals are signals obtained by multiplying a saturation S of the input signals by a gain value Sgain, and when a maximum value of the brightness of the input signals is denoted as Max, a minimum value of the brightness of the input signals is denoted as Min, and a set value Sparam is given such that $0 \leq Sparam < 1$, the gain value Sgain is given by the following expression (2):

$$Sgain=Sparam\times[1-(Max-Min)] \quad (2).$$

(X4) The display device according to (X1), wherein the converted input signals are obtained by multiplying a saturation S of the input signals by a gain value Sgain, and when a minimum value of the brightness of the input signals is denoted as Min and a set value Sparam is given such that $1 < Sparam$, the gain value Sgain is given by the following expression (1):

$$Sgain=(Sparam-1)\times Min+1 \quad (1).$$

(X5) The display device according to (X1), wherein the converted input signals are obtained by multiplying a saturation S of the input signals by a gain value Sgain, and when a maximum value of the brightness of the input signals is denoted as Max, a minimum value of the brightness of the input signals is denoted as Min, and a set value Sparam is given such that 1<Sparam, the gain value Sgain is given by the following expression (2):

$$Sgain=Sparam\times[1-(Max-Min)] \quad (2).$$

What is claimed is:

1. A display device comprising:

a display unit including pixels arranged in a matrix therein, each of the pixels including, a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit generates converted input signals with changed saturation among the input signals, the converted input signals being obtained by multiplying a saturation S of the input signals, which is given by the following expression (1), by a gain value Sgain, which is given by the following expression (2):

$$S=(Max-Min)/Max \quad (1),$$

$$Sgain=(Sparam-1)\times Min+1 \quad (2)$$

where a maximum value of the brightness of the input signals is denoted as Max, a minimum value of the brightness of the input signals is denoted as Min, and a set value Sparam is given such that 0≤Sparam<1, and the signal processing unit calculates output signals to the first sub-pixel, the second sub-pixel, and the third sub-pixel based on the converted input signals and an amount of increase in brightness caused by the fourth sub-pixel.

2. A display device comprising:

a display unit including pixels arranged in a matrix therein, each of the pixels including, a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit generates converted input signals with changed saturation among the input signals, the converted input signals being obtained by multiplying a saturation S of the input signals, which is given by the following expression (1), by a gain value Sgain, which is given by the following expression (2):

$$S=(Max-Min)/Max \quad (1),$$

$$Sgain=Sparam-[1-(Max-Min)] \quad (2),$$

where a maximum value of the brightness of the input signals is denoted as Max, a minimum value of the brightness of the input signals is denoted as Min, and a set value Sparam is given such that 0≤Sparam<1, and the signal processing unit calculates output signals to the first sub-pixel, the second sub-pixel, and the third sub-pixel based on the converted input signals and an amount of increase in brightness caused by the fourth sub-pixel.

3. A display device comprising:

a display unit including pixels arranged in a matrix therein, each of the pixels including, a first sub-pixel that displays a first color component, a second sub-pixel that displays a second color component, a third sub-pixel that displays a third color component, and a fourth sub-pixel that displays a fourth color component different from the first sub-pixel, pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit generates converted input signals with changed saturation among the input signals, the converted input signals being obtained by multiplying a saturation S of the input signals, which is given by the following expression (1), by a gain value Sgain, which is given by the following expression (2):

$$S=(Max-Min)/Max \quad (1),$$

$$Sgain=(Sparam-1)\times Min+1 \quad (2),$$

where a minimum value of the brightness of the input signals is denoted as Min and a set value Sparam is given such that 1<Sparam, and the signal processing unit calculates output signals to the first sub-pixel, the second sub-pixel, and the third sub-pixel based on the converted input signals and an amount of increase in brightness caused by the fourth sub-pixel.

4. A display device comprising:

a display unit including pixels arranged in a matrix therein, each of the pixels including, a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit generates converted input signals with changed saturation among the input signals, the converted input signals being obtained by multiplying a saturation S of the input signals, which is given by the following expression (1), by a gain value Sgain, which is given by the following expression (2):

$$S=(\mathrm{Max}-\mathrm{Min})/\mathrm{Max} \quad (1),$$

$$S\mathrm{gain}=S\mathrm{param}-[1-(\mathrm{Max}-\mathrm{Min})] \quad (2),$$

where a maximum value of the brightness of the input signals is denoted as Max, a minimum value of the brightness of the input signals is denoted as Min, and a set value Sparam is given such that 1<Sparam, and the signal processing unit calculates output signals to the first sub-pixel, the second sub-pixel, and the third sub-pixel based on the converted input signals and an amount of increase in brightness caused by the fourth sub-pixel.

* * * * *